US006270163B1

(12) United States Patent
Mullet et al.

(10) Patent No.: US 6,270,163 B1
(45) Date of Patent: Aug. 7, 2001

(54) MINING MACHINE WITH MOVEABLE CUTTING ASSEMBLY AND METHOD OF USING THE SAME

(75) Inventors: Merle R. Mullet; Rex A. Hummel, both of Millersburg, OH (US)

(73) Assignee: Holmes Limestone Co., Berlin, OH (US)

( * ) Notice: Subject to any disclaimer, the term of this patent is extended or adjusted under 35 U.S.C. 154(b) by 0 days.

(21) Appl. No.: 09/152,638

(22) Filed: Sep. 14, 1998

(51) Int. Cl.[7] ..... E21C 29/52
(52) U.S. Cl. ..... 299/75; 299/57; 299/65
(58) Field of Search ..... 299/68, 73, 75, 299/33, 57, 85.1

(56) References Cited

U.S. PATENT DOCUMENTS

| | | | | |
|---|---|---|---|---|
| Re. 17,603 | * | 2/1930 | Levin | 299/75 X |
| 1,737,045 | * | 11/1929 | Davis | 299/75 X |
| 1,765,524 | * | 6/1930 | Davis | 299/75 X |
| 2,283,212 | * | 5/1942 | Joy | 299/57 X |
| 2,330,437 | * | 9/1943 | Lovely | 299/75 X |
| 2,595,398 | * | 5/1952 | Lewis | 299/65 |
| 2,821,374 | | 1/1958 | Gardner . | |
| 3,006,624 | * | 10/1961 | Doxey | 299/65 |
| 3,044,753 | | 7/1962 | Wilcox, Jr. . | |
| 3,148,917 | * | 9/1964 | Thompson | 299/25 |
| 3,642,325 | | 2/1972 | Mulvaney . | |
| 3,663,054 | * | 5/1972 | Dubois | 299/68 X |
| 3,784,257 | | 1/1974 | Lauber et al. . | |
| 4,003,602 | | 1/1977 | Justice et al. . | |
| 4,014,574 | | 3/1977 | Todd . | |
| 4,021,076 | | 5/1977 | Hawthorne et al. . | |
| 4,040,669 | | 8/1977 | Franklin . | |
| 4,082,362 | | 4/1978 | Justice et al. . | |
| 4,185,873 | | 1/1980 | Bohnes et al. . | |
| 4,189,186 | | 2/1980 | Snyder . | |
| 4,226,476 | | 10/1980 | Fairchild et al. . | |
| 4,254,993 | | 3/1981 | McGee et al. . | |
| 4,312,541 | | 1/1982 | Spurgeon . | |
| 4,362,337 | | 12/1982 | Casanova . | |
| 4,637,657 | | 1/1987 | Snyder . | |
| 4,770,469 | * | 9/1988 | Schellenberg et al. | 299/75 X |
| 4,889,392 | | 12/1989 | Justice et al. . | |
| 5,125,719 | | 6/1992 | Snyder . | |
| 5,180,209 | | 1/1993 | Bieri . | |
| 5,205,612 | | 4/1993 | Sugden et al. . | |
| 5,205,613 | | 4/1993 | Brown, Jr. . | |
| 5,219,246 | | 6/1993 | Coutts et al. . | |
| 5,582,466 | | 12/1996 | Delli-Gatti, Jr. . | |
| 5,836,658 | * | 11/1998 | Mraz | 299/75 X |

FOREIGN PATENT DOCUMENTS

| | | |
|---|---|---|
| 533456 | 11/1983 | (AU) . |
| WO95/02747 | 1/1995 | (WO) . |

OTHER PUBLICATIONS

650 Coal Age, No., 6, New York, USA (XP–002122553), (1986).

* cited by examiner

*Primary Examiner*—Eileen D. Lillis
*Assistant Examiner*—Sunil Singh
(74) *Attorney, Agent, or Firm*—Renner, Kenner, Greive, Bobak, Taylor & Weber

(57) ABSTRACT

A mining machine (20) for combined entry and retreat cutting of material located in underground seams including, a movable mainframe (21), a wing (50, 51) extending ahead of the movable mainframe, a cutter assembly (100) positionable proximate the end of the wing for entry cutting a hole in the material when the wing is aligned with the direction of movement of the mainframe, a pivotal connection (130) between the mainframe and the wing for orienting the wing at an angle to the direction of the movement of the mainframe, and a carriage mechanism (80) for moving the cutter assembly along the wing for cutting of the material in proximity to the wing during retreat cutting of the material.

35 Claims, 17 Drawing Sheets

MINING MACHINE WITH MOVEABLE CUTTING ASSEMBLY AND METHOD OF USING THE SAME

TECHNICAL FIELD

The present invention relates generally to a method and apparatus for mining minerals, such as coal, from underground seams. More particularly, the present invention relates to a method and apparatus for carrying out high wall and underground mining operations of mineral seams in a highly efficient, safe, and inexpensive manner. More specifically, the present invention relates to a method and apparatus for carrying out high wall and underground mining operations wherein substantially the entirety of a mineral seam can be recovered, selective collapse of the ground into the mined seam can be effected, and the apparatus and method of operation are relatively simple while permitting high production rates.

BACKGROUND ART

Mining equipment has long been a key to economically successful mining operations. Originally, underground mining of thicker seams was the primary focus for coal-mining enterprises. With significant depletion of thick seams and additional focus on the safety and health implications of such mining, more attention has been concentrated in recent years on mining thinner seams of coal in both surface and underground mining operations. To accomplish better economics, surface miners uncovered as much overburden as was economically feasible for a given thickness of coal and then augured underground into the exposed high wall, recovering additional tons without the expense of removing the overburden. Until recently, these were round augers limited to short underground penetration distances. The advent of the high wall miner using a continuous underground mining machine in front of a conveyor system has allowed significant improvement in penetration depths. The major drawbacks in all auger and high wall mining operations have been localized roof falls and leaving enough space between holes to prevent collapse of the complete hill structure. Leaving enough coal to prevent collapse is extremely inefficient in that substantial pockets of coal remain after the mining operation, and there are possibilities of later subsidence into the bore holes in an uncontrolled and unscheduled manner. The aforesaid inefficiency of conventional high wall mining is particularly significant in instances where the surface of the seam follows a curvilinear path, such that only an extremely small fraction of the seam can be retrieved when employing spaced surface holes.

Efforts have been made over the years to improve recovery rates achievable by high wall mining apparatus. In that respect, different cutter head designs have been developed to achieve improved cutting action. There have also been developments in improving power systems and equipment reliability to reduce down time of high wall mining equipment.

Also, efforts have been made to expand the application of high wall miners beyond traditional applications by effecting higher and wider cuts. In this respect, cutter heads with larger diameters have been developed, together with larger motors, increased conveyor speeds, and the requisite interface equipment. Another more sophisticated approach has been the development of equipment that initially cuts a conventional bore and then proceeds to ream the bore to slightly larger dimensions. In this latter respect, a bore is made horizontally, normally with conventional cutting apparatus. In most instances, these high wall miners cut substantially greater quantities of minerals during the entry phase, with the hole size being only slightly augmented by reaming cutters. In this respect, various types of cutters have been developed for the reaming action, which are normally contracted during the conventional cutting and subsequently expanded during the return cutting operation. In other instances, the main cutter may be pivoted or otherwise minimally offset from the hole produced during the entry phase to produce the retreat reaming cut.

These combined cutting and reaming machines achieve only minor productivity advancements in relation to the complexities and disadvantages that are involved. In most instances, the cutters for the reaming operation are normally located rearwardly on the machine from the entry phase cutters. This, of course, presents the possibilities of a roof collapse, which can trap the mining equipment underground. As a result, limitations are frequently applied to the extent of the cut made by the reaming cutters, such as to minimize the possibility of roof collapse. These systems also have the disadvantage that even though round holes are cut, frequently there remain potential subsidence problems years after mining operations are completed. Thus, developments in high wall mining equipment over recent years have, for the most part, involved refinements to existing equipment and methods.

DISCLOSURE OF THE INVENTION

Therefore, an object of the present invention is to provide a mining machine and process that is particularly useful in regard to high wall and underground mining operations in constituting a total subsidence remote mining system. Another object of the present invention is to provide such a mining machine and process wherein a coal seam is entered by cutting a relatively small and narrow rectangular hole, which is, therefore, not prone to accidental collapse during the entry phase of a mining operation. Another object of the present invention is to provide such a mining machine and process wherein wings of substantial length are expanded to carry out cutting during a retreat mining operation, such that a great preponderance of the mining operation is effected during the retreat mining operation. Another object of the present invention is to provide a mining machine that employs a pair of adjacent, vertically-mounted cutter heads that cut a relatively narrow square or rectangular hole during entry into a mineral seam. A further object of the present invention is to provide a mining machine wherein the cutters employed in the entry phase are movably mounted on a pair of wings for positioning at the leading extremity of the wings during the entry cutting operating phase. Still another object of the invention is to provide such a mining machine wherein the cutting heads move along the length of the wings during the spreading of the wings to the retreat cutting position and, thereafter, during the retreat cutting operation. Yet a further object of the invention is to provide such a mining machine wherein each wing contains an auger that transports cut minerals from a seam to an auger conveyor in the mainframe of the machine that, in conjunction with suitable extensible conveying apparatus, transports cut minerals to the surface of the ground.

A still further object of the present invention is to provide a mining machine wherein the cutting width during the retreat cutting phase approaches the length of the two wings. A further object of the present invention is to provide such a mining machine wherein during the retreat cutting phase, each cutting cycle along the leading edge of the wings is followed by movement of the wings in the direction of the retreat cut, which is approximately the diameter of the cutting heads. Yet another object of the present invention is to provide such a mining machine wherein the same two cutters are variously positioned and operated to effect the cutting operations during both the entry and retreat operations of the machine. Yet a further object of the present invention is to provide such a mining machine that allows for essentially complete recovery of a coal seam, irrespective of the terrain conditions, which is not possible with conventional high wall machinery.

Another object of the present invention is to provide a high wall mining machine that allows for total subsidence, which is not possible with existing high wall miners. Another object of the present invention is to provide an underground mining machine that, in not requiring the presence of workers in the subsidence area, allows for recovery of much thinner seams than existing total-recovery systems. Another object of the present invention is to provide such a mining machine wherein the cutters and wings operate in close proximity to uncut minerals in the seam and constitute the trailing portion of the machine during the retreat phase, thereby minimizing possibilities of collapse or roof falls due to what is, in effect, a shielded area of in-place minerals preceding the total subsidence that is effected by the subject machine.

Yet a further object of the present invention is to provide a mining machine that cuts a minimum of minerals during the entry phase while employing sensors to gather information in regard to the topography of the seam. This information can then be used to adjust the location of the retreat mode to maximize positioning within a seam for full recovery by taking into account changes in topography that take place during the retreat mode when the great majority of the material recovery takes place. A further object of the present invention is to provide such a mining machine wherein controlled retraction and expansion of the wings is possible during retreat in order to vary the cutting width to accommodate a crooked high wall as it follows the contour of hills, which is not possible with a fixed-width machine. This expansion and retraction is also desirable in order to leave the high wall intact as the machine withdraws from the hole. Still another object of the present invention is to provide such a mining machine that may be constructed to optimize performance in various seam heights and various cutting widths appropriate for particular geological conditions.

Yet a further object of the present invention is to provide such a mining machine that uses sidewall grippers for movement of the miner and conveying equipment into and out of the seam, therefore requiring only a fraction of the size of supporting equipment outside of the hole as compared to conventional high wall mining machines whose weight must be sufficient to propel the equipment into and out of the hole. Sidewall grippers are possible in this application because the minerals proximate to the previously mined hole will not be mined until the retreat phase, which is after the grippers have passed, whereas conventional methods must leave a pillar between holes large enough to support the roof. Yet a further object of the present invention is to provide such a milling machine that requires a minimum of operators, and is relatively inexpensive in comparison with conventional high wall machines having comparable mining characteristics.

In general, the present invention contemplates a mining machine for combined entry and retreat cutting of material located in underground seams including, a movable mainframe, a wing extending ahead of the movable mainframe, a cutter assembly positionable proximate the end of the wing for entry cutting a hole in the material when the wing is aligned with the direction of movement of the mainframe, a pivotal connection between the mainframe and the wing for orienting the wing at an angle to the direction of movement of the mainframe, and a carriage mechanism for moving the cutter assembly along the wing for cutting of the material in proximity to the wing during retreat cutting of the material.

The present invention also contemplates a method of mining minerals located in an underground seam, including the steps of cutting an entry hole in the underground seam, locating a mining machine having a wing-mounted cutter assembly in the entry hole, moving the cutter assembly lengthwise of the wing to effect a widening cut of the entry hole in the area adjacent to the wing, spreading the wing angularly into the widening cut effected by the cutter assembly, sequentially repeating the moving of the cutter assembly lengthwise of the wing to effect a further widening cut to the entry hole and the spreading of the wing angularly into widening cuts until the wing is displaced through a desired angle, instituting retreat motion increments of the mining machine and the wing subsequent to advance cuts by the cutter assembly lengthwise of the wings, whereby a retreat cut of a width exceeding the width of the entry hole is accomplished.

PREFERRED EMBODIMENT FOR CARRYING OUT THE INVENTION

Figure 1:
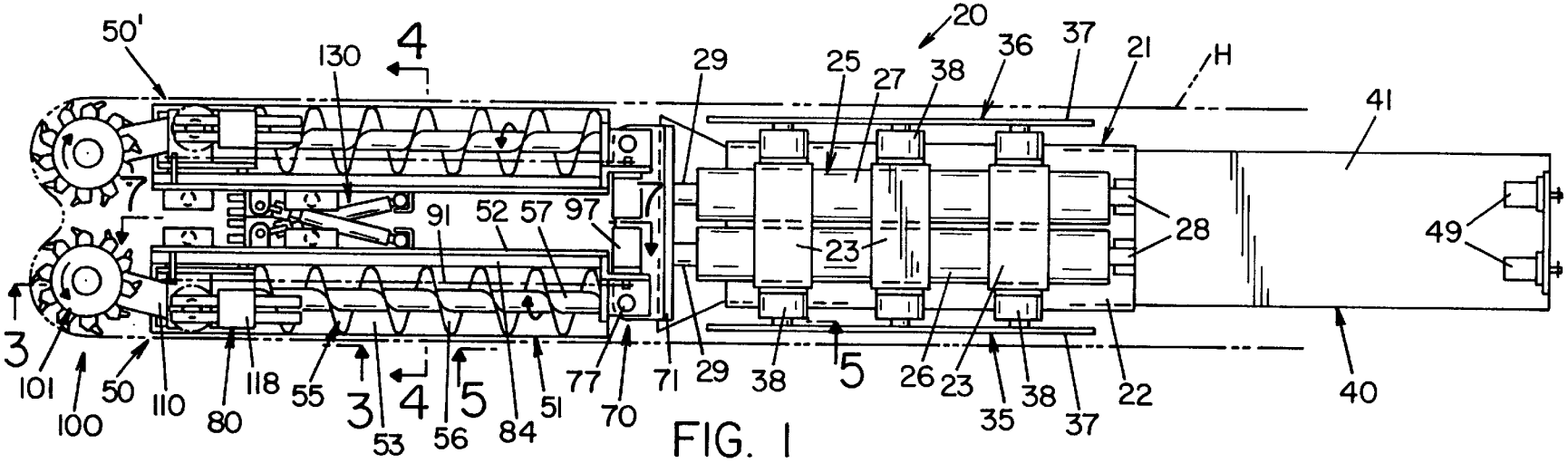
FIG. 1 is a partially-schematic top plan view of exemplary mining apparatus according to the concepts of the present invention, shown in relation to a bore into an underground mineral seam and depicting the overall layout.
Figure 2:
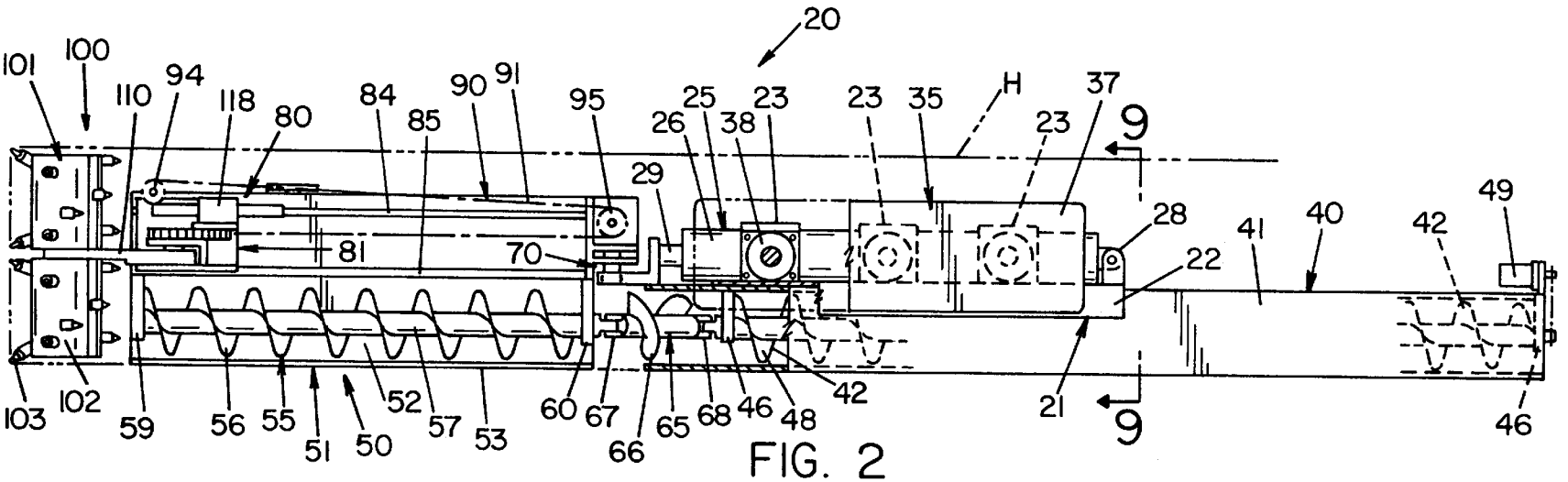
FIG. 2 is a partially-schematic side-elevational view of the mining apparatus of FIG. 1 showing additional features of the overall layout.

The mining machine according to the concepts of the present invention is generally indicated by the numeral 20 in FIGS. 1 and 2. As shown, the mining machine 20 is depicted in operative relation to a cut hole H in the entry phase of a typical high wall mining operation. For purposes of orientation, the mining machine 20 is depicted as proceeding in the cut hole H from right to left, as depicted in FIGS. 1 and 2.

Figure 9:
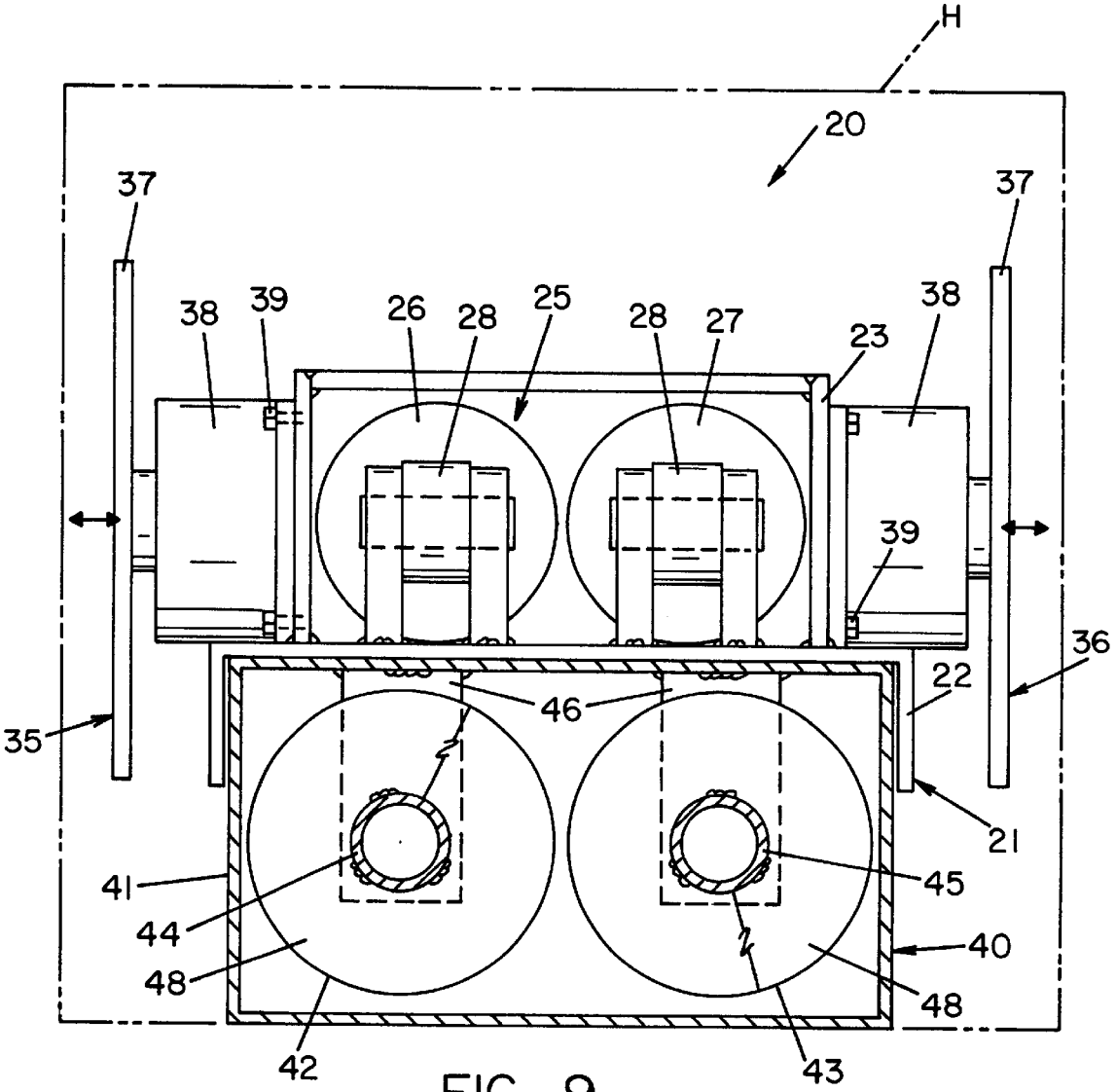
FIG. 9 is a rear-elevational view of the mining apparatus of FIG. 1 taken substantially along the line 9—9 of FIG. 2 and showing details of the mainframe and augers.

The mining machine 20 has as a primary component a mainframe assembly, generally indicated by the numeral 21, that interfaces with conveyors extending to the surface of the ground. The mainframe assembly 21 has, as a primary structural member, a platform 22, which may be a down-turned U-shaped member, as best seen in FIG. 9. The platform 22 carries on its upper surface an attached housing 23, which may also be of a down-turned U-shaped configuration. Still referring to FIGS. 1, 2, and 9, the housing 23 encloses a mainframe drive assembly, generally indicated by the numeral 25. As shown, the mainframe drive assembly 25 has a pair of advance and retract cylinders 26 and 27 that are conveniently positioned in parallel, side-by-side relationship. The advance and retract cylinders 26, 27 each have a blind end 28 attached to the platform 22 and a rod end 29, which is operative as hereinafter described.

As seen in FIGS. 1, 2, and 9, the mainframe assembly 21 also includes a pair of mainframe clamping mechanisms, generally indicated by the numerals 35 and 36. As shown, the mainframe clamping mechanisms 35, 36 include enlarged clamping plates 37 that extend laterally to either side of the mainframe assembly 21. The mainframe clamping plates 37 are attached to one or more clamping cylinders 38, which are affixed to the housing 23 as by cap screws 39. As best seen in FIG. 9, the clamping cylinders 38 are selectively actuated to move the clamping plates 37 into and out of engagement with the rectangular cut hole H produced by mining machine 20 in a known manner for moving the mainframe assembly 21 in incremental steps into and out of a cut hole H.

Referring now to FIGS. 1, 2, 5, and 9, the mainframe assembly 21 includes a mainframe conveyor system, generally indicated by the numeral 40. The mainframe conveyor system 40 has an elongate chute 41 that may be generally rectangular in cross-section. As shown, the chute 41 fits within the U-shaped platform 22 for relative motion with respect to platform 22 and housing 23 longitudinally of mainframe assembly 21.

Mounted internally of chute 41 of mainframe conveyor system 40 are a pair of mainframe augers 42, 43 that extend substantially the length of the chute 41. The augers 42, 43 preferably have auger shafts 44 and 45 that are in substantially parallel alignment and extend substantially the longitudinal length of the chute 41. The auger shafts 44, 45 are supported on brackets 46 carrying bearings 47 (FIG. 5) preferably proximate the ends of and, as might be necessary, interspersed along the length of shafts 44, 45. The auger shafts 44, 45 carry spiral blades 48, which may be any of various designs known in the industry. The auger shafts 44, 45 are driven by one or more suitable auger motors 49 to transport coal or other minerals along and to the rear of mainframe assembly 21, which is from left-to-right, as depicted in FIGS. 1 and 2 of the drawings. It will be appreciated that additional conveyor units (not shown), which may be the same as or similar to mainframe conveyor system 40, may be attached to the chute 41 proximate auger motors 49 to transport mined minerals to the surface where cut hole H commences as the mining machine 20 proceeds underground following a seam of minerals.

Disposed ahead of the mainframe assembly 21 of mining machine 20 in exemplary cut hole H are a pair of cutter wing assemblies, generally indicated by the numerals 50 and 50'. As viewed from the top and facing into the cut hole H in FIG. 1, the left cutter wing assembly is designated by the numeral 50, and the right cutter wing assembly is designated by the numeral 50'. The cutter wing assemblies 50 and 50' may be of identical configuration except that each is constructed essentially as a mirror image of the other. Therefore, the following discussion covers the structure of both of the cutter wing assemblies 50 and 50', although directed specifically to the left cutter wing assembly 50. Referring now to FIGS. 1–6 of the drawings, cutter wing assembly 50 has an outwardly open L-shaped frame 51. As shown, the frame 51 has a vertical member 52 and a lower horizontal member 53.

Positioned within the lower reaches of L-shaped frame 51 proximate the joinder of vertical member 52 and horizontal member 53 is a wing conveyor system, generally indicated by the numeral 55. The wing conveyor system 55 has a wing auger 56 that extends essentially the full length of the L-shaped frame 51. The wing auger 56 has a wing auger shaft 57 extending beyond both longitudinal extremities of wing auger 56 and rotatably mounted in relation to a front support post 59 and a rear support post 60 affixed to the frame 51.

Figure 3:
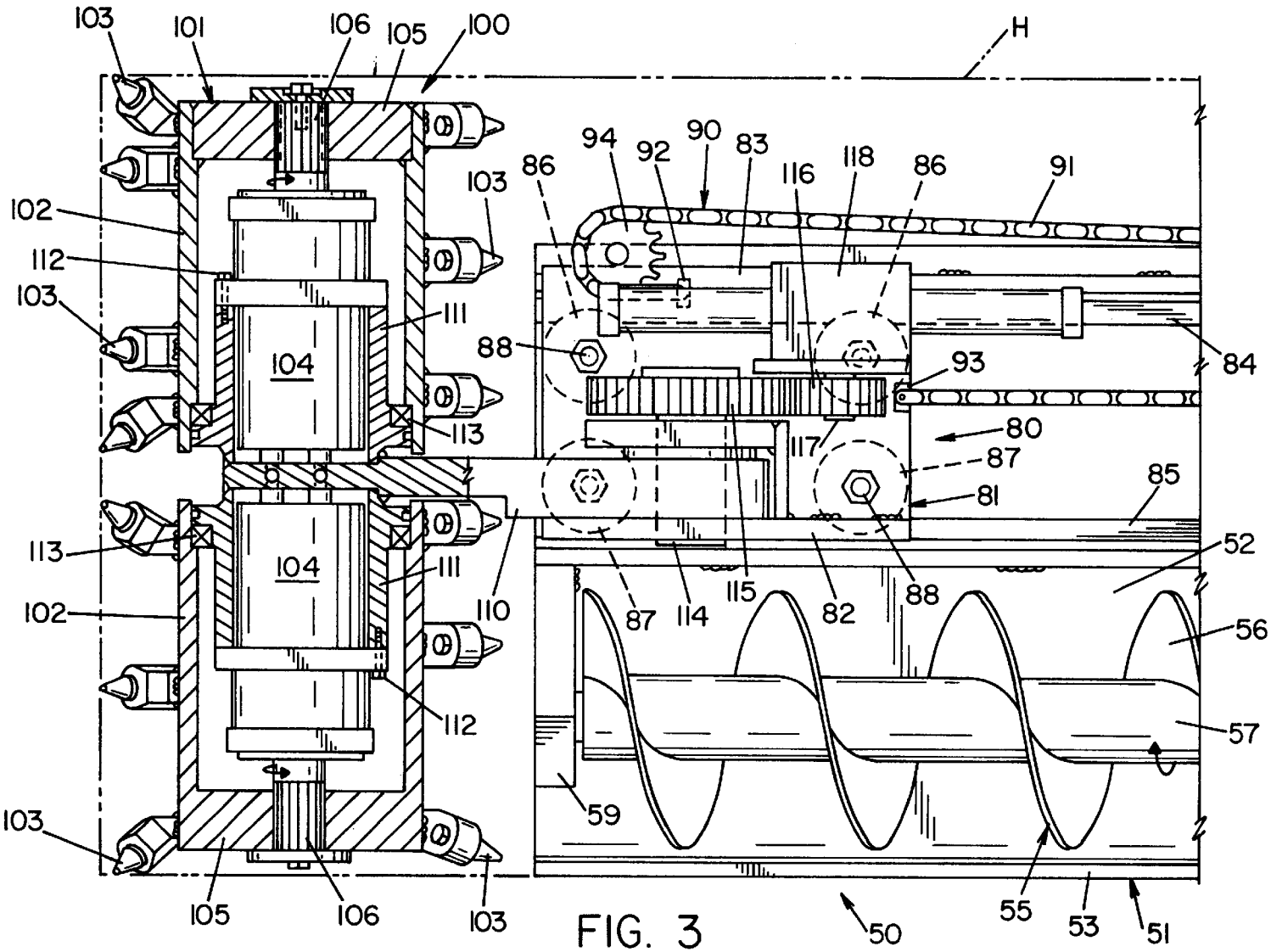
FIG. 3 is an enlarged fragmentary-elevational view of the apparatus of FIG. 1 taken substantially along the line 3—3 of FIG. 1 and showing a wing, a carriage, a support arm, and a cutting head.
Figure 4:
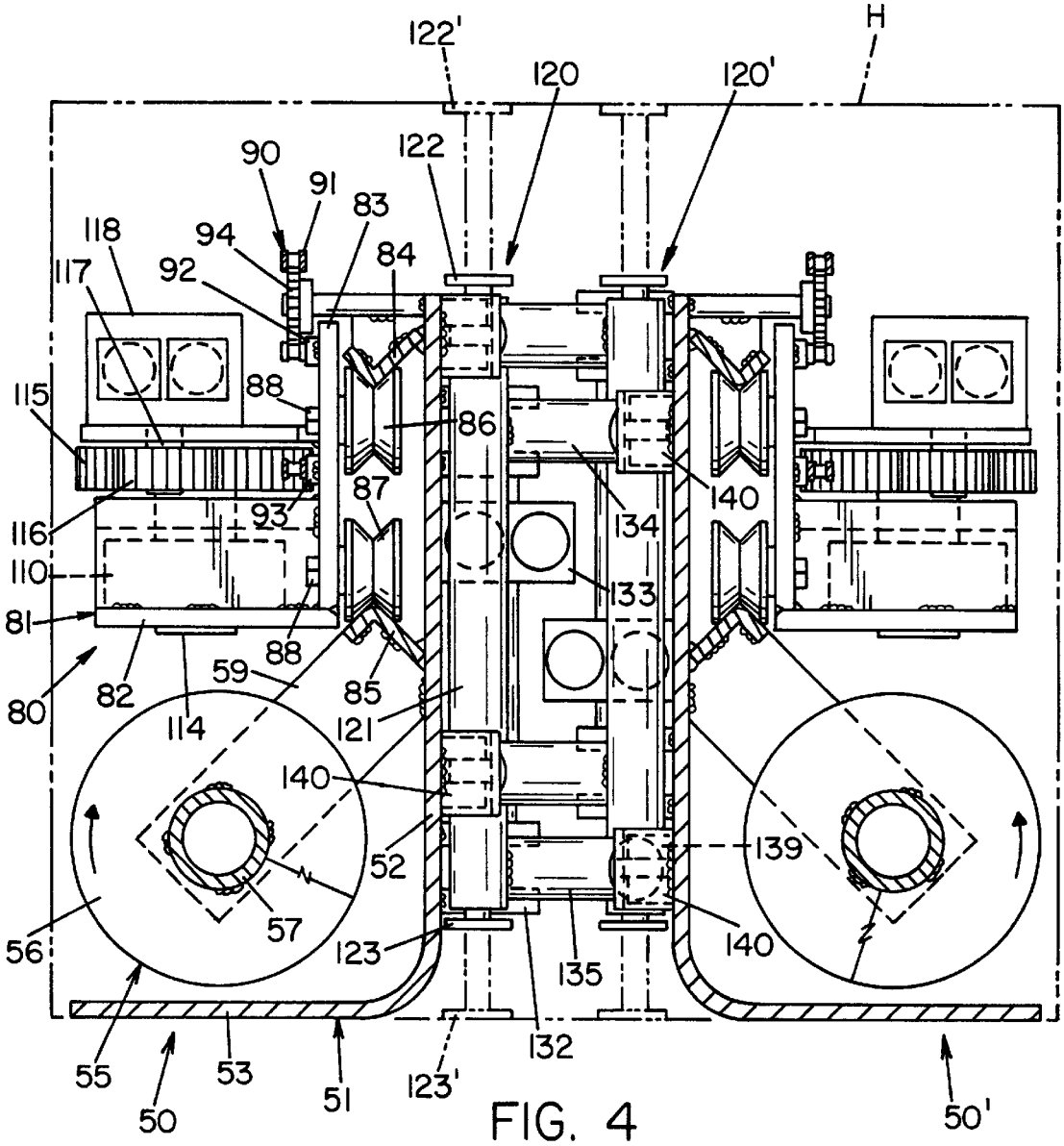
FIG. 4 is an enlarged elevational view of the mining apparatus of FIG. 1 taken substantially along the line 4—4 of FIG. 1 and showing details of the interrelation between the wings and the carriages.
Figure 5:
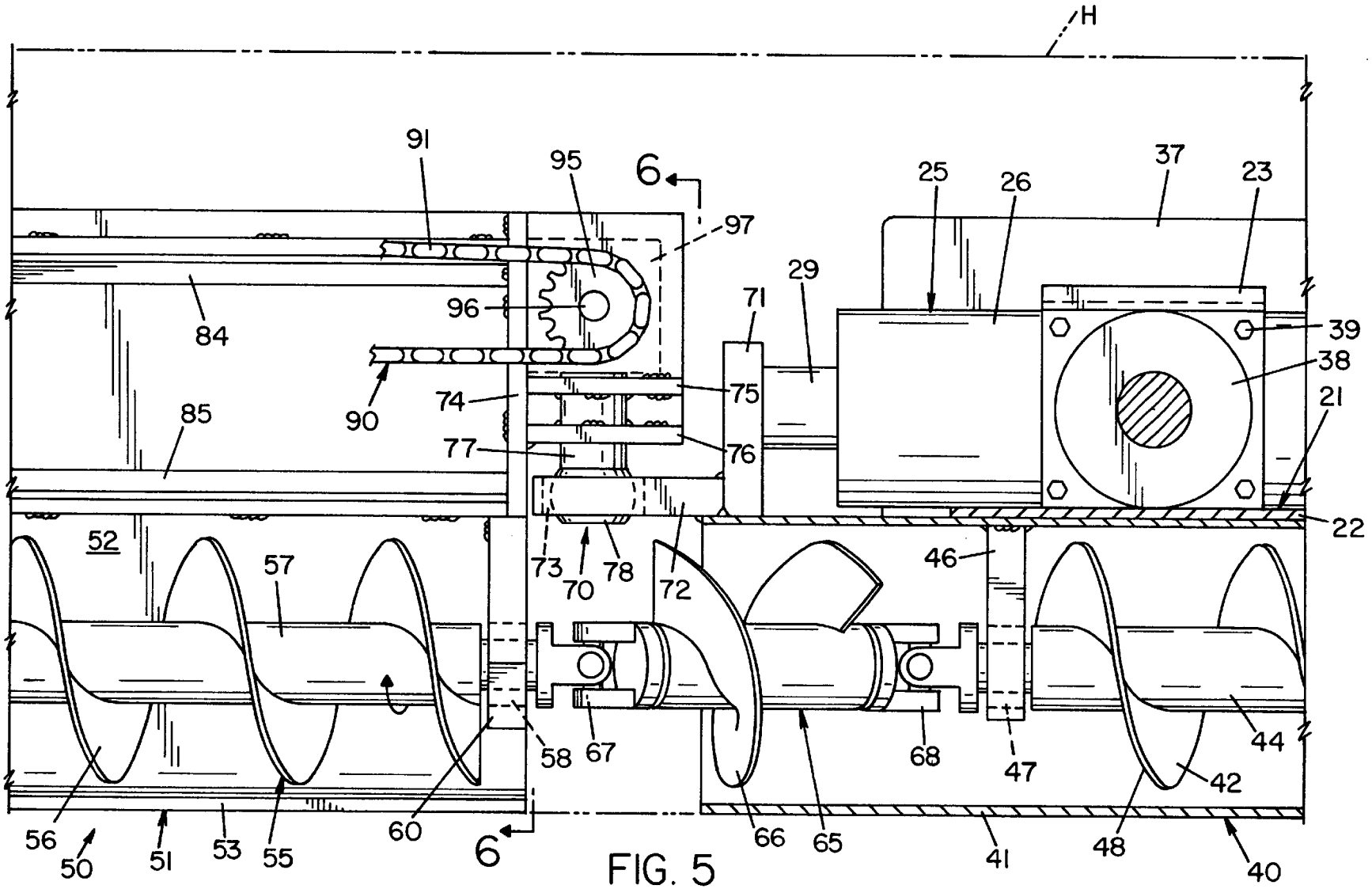
FIG. 5 is an enlarged fragmentary-elevational view of the mining apparatus of FIG. 1 taken substantially along the line 5—5 of FIG. 1 and showing details of the interconnection between the movable mainframe and the wings.

It will thus be appreciated that rotation of wing auger 56 ofwing conveyor system 55 in the direction indicated in FIGS. 3–5 of the drawings would serve to transport loose material in cut hole H from front to rear of cutter wing cutter assembly 50 as restrained by the L-shaped frame 51. It is further to be appreciated that cut material introduced at any position longitudinally of wing conveyor system 55 from outwardly of wing conveyor system 55 will be transported rearwardly within the L-shaped frame 51 to the rear of cutter wing assembly 50.

The wing conveyor system 55 interrelates with and is powered by a conveyor interconnect mechanism, generally indicated by the numeral 65. The conveyor interconnect mechanism 65 consists of a short extent of auger 66, which is joined at its ends to wing auger shaft 57 and mainframe auger shaft 44 as by universal joints 67 and 68, respectively.

It will thus be appreciated that auger motor 49 may power both the mainframe conveyor system 40 and the wing conveyor system 55 due to the conveyor interconnect mechanism 65. It will also be understood that with appropriate placement of the universal joints 67, 68 of conveyor interconnect mechanism 65, cutter wing assembly 50 may be displaced angularly with respect to the mainframe assembly 21 while still providing for rotation of the augers 42 and 66. Further, the section of auger 66 on conveyor interconnect mechanism 65 effects transfer of cut material from the wing conveyor system 55 to the mainframe conveyor system 40 and subsequently within the chute 41, such as to move cut material rearwardly of the mining machine 20.

Figure 6:
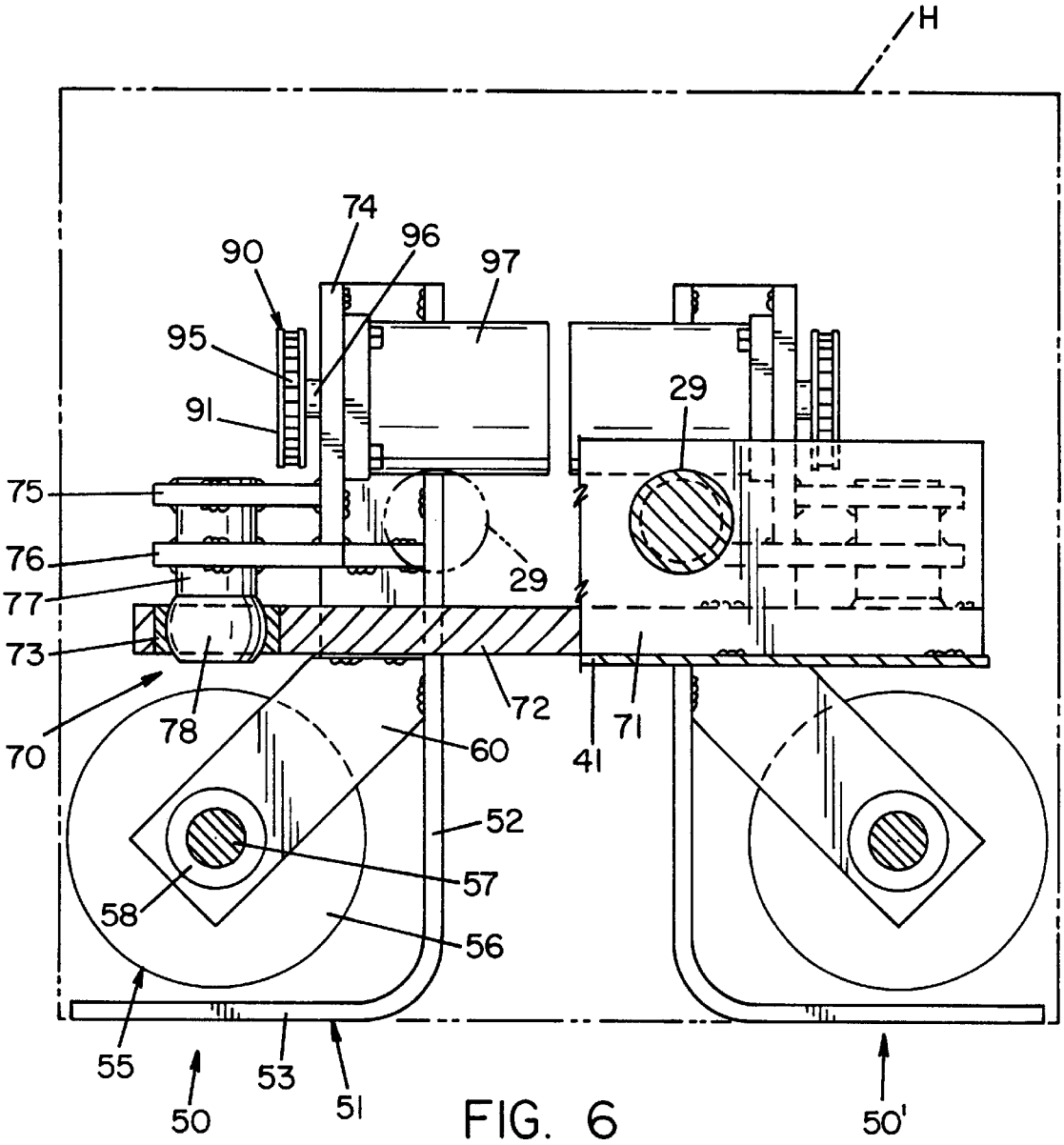
FIG. 6 is a vertical sectional view of the mining apparatus of FIG. 1 taken substantially along the line 6—6 of FIG. 5 with portions broken away and showing details of the interconnection between the mainframe and the wings.

Cutter wing assembly 50 is movable a distance longitudinally of, and angularly with respect to, mainframe assembly 21 by a pivot assembly, generally indicated by the numeral 70, as best seen in FIGS. 2, 5, and 6. The pivot assembly 70 has a drive plate 71 that is attached to the rod end 29 of advance and retract cylinder 26 of mainframe drive assembly 25 and to the chute 41 of mainframe conveyor system 40. The drive plate 71 has an attached forward projecting offset arm 72 that mounts a spherical bearing socket 73. The cutter wing assembly 50 has a laterally projecting auxiliary frame 74 with spaced parallel arms 75 and 76 that carry a rod 77 mounting a spherical ball that engages the spherical bearing socket 73 in offset arm 72 of drive plate 71. It will be appreciated that the interconnection between spherical ball 78 and spherical bearing socket 73 permits a substantial extent of lateral angular motion of cutter wing assembly 50 relative to mainframe assembly 21. In addition, the spherical ball 78 and spherical bearing socket 73 permit a minor extent of vertical angular motion of cutter wing assembly 50 relative to mainframe assembly 21.

The cutter wing assembly 50 has a cutter carriage assembly, generally indicated by the numeral 80, located generally within the L-shaped frame 51 and above the wing conveyor system 55. Referring to FIGS. 1–6, inclusive, the cutter carriage assembly 80 has a carriage frame 81 having a horizontal leg 82 and an upright leg 83 that generally parallels the horizontal member 53 and vertical member 52 of L-shaped frame 51, respectively (FIG. 4). The carriage frame 81 is movable along essentially the fill longitudinal length of L-shaped frame 51 of cutter wing assembly 50 on a pair of spaced, horizontally-disposed rails, namely, upper rail 84 and lower rail 85. As shown, the rails 84, 85 are of a V-shaped, in-turned configuration that matingly engage correspondingly grooved upper wheels 86 and lower wheels 87 of carriage frame 81. As best seen in FIGS. 3 and 4, the carriage frame 81 has a pair of horizontally-spaced upper wheels 86 and a pair of lower wheels 87, all of which are freely rotatably mounted on carriage frame 81 by bolts 88. Thus, the carriage frame 81 is mounted for horizontal travel for positioning along the L-shaped frame 51 of cutter wing assembly 50.

The carriage frame 81 is selectively positioned along the rails 84, 85 by a carriage drive assembly, generally indicated by the numeral 90. The carriage drive assembly 90 consists of a discontinuous drive chain 91 having one end affixed to a first chain end attachment bracket 92 and the other end affixed to a second chain end attachment bracket 93, both rigidly attached to upright leg 83 of the carriage frame 81. The drive chain 91 is reeved about an idler sprocket 94 mounted proximate the forward end of the L-shaped frame 51 of cutter wing assembly 50. The drive chain 91 is also reeved about a drive sprocket 95 that is affixed to L-shaped frame 51 proximate the rear or trailing end of cutter wing assembly 50. The drive sprocket 95 is mounted on the shaft 96 (see FIG. 6) of a carriage drive motor 97. The drive motor 97 is a reversible motor that may be energized to move carriage frame 81 at a selected speed and a selected direction along the rails 84, 85 attached to the L-shaped frame 51 of the cutter wing assembly 50.

The cutter carriage assembly 80 operatively mounts a cutter assembly, generally indicated by the numeral 100, which is best seen in FIGS. 1–4 of the drawings. The cutter assembly 100 has a cutter head 101 that, as shown, consists of a pair of axially-aligned, vertical-oriented drums 102. The exterior surface of the drums 102 carries aplurality of axially- and circumferentially-spaced cutters 103 that are designed to effect a cut in a mineral seam, dirt, and the like encountered in mining operations. The drums 102 are rotated by hydraulic motors 104 positioned within the confines of the drums 102. The drums 102 have axially-outward end caps 105 that are non-rotatably affixed on splined shafts 106 of the hydraulic motors 104. Thus, it will be appreciated that the drums 102 may be selectively rotated by hydraulic motors 104 at a desired speed to optimize cutting operations effected by the cutters 103 on drums 102. The hydraulic motors 104 may advantageously be reversible, such as to permit rotation of drums 102 in either direction, depending on cutting techniques being employed, and to permit brief reversals in the rotational direction of drums 102 of cutter head 101 in the event drums 102 become temporarily jammed due to the quantity or content of the material being cut at a given time.

Interposed between and mounting drums 102 on each cutter head 101 is an elongate cutting arm 110. The cutting arm 110 mounts opposed extending collars 111 to which the hydraulic motors 104 are attached as by bolts 112. The collars 111 also seat bearings 113 outwardly thereof upon which drums 102 rotate when actuated by hydraulic motors 104. It will be appreciated that the cutter assembly 100 and its interrelation with cutting arm 110 is merely exemplary of various types of cylindrical cutting heads that are known in the industry. Any of various cylindrical cutter head designs could be employed as long as appropriately sized and powered.

The extremity of cutting arm 110 opposite the cutter head 101 is pivotally affixed to the carriage frame 81. As shown, the cutting arm 110 is non-rotatably affixed to a pivot pin 114 (FIG. 3). The pivot pin 114 extends through a portion of carriage frame 81 and has a gear 115 non-rotatably affixed thereon. Thus, it will be appreciated that rotation of the gear 115 provides equiangular rotation of cutting arm 110 about the pivot pin 114. The gear 115 is in engagement with a pinion 116. The pinion 116 is mounted on a shaft 117 of a rotary actuator 118 attached to the carriage frame 81. Thus, it will be seen that energizing rotary actuator 118 effects angular movement of cutter head 101 about pivot pin 114 through action of the shaft 117 and the pinion 116. In that respect, the cutter head 101 may be rotated from a position substantially in alignment with L-shaped frame 51 of cutter wing assembly 50, as seen in FIGS. 1 and 2, to a position substantially perpendicular thereto, as depicted, for example, in FIG. 13D of the drawings.

Figure 7:
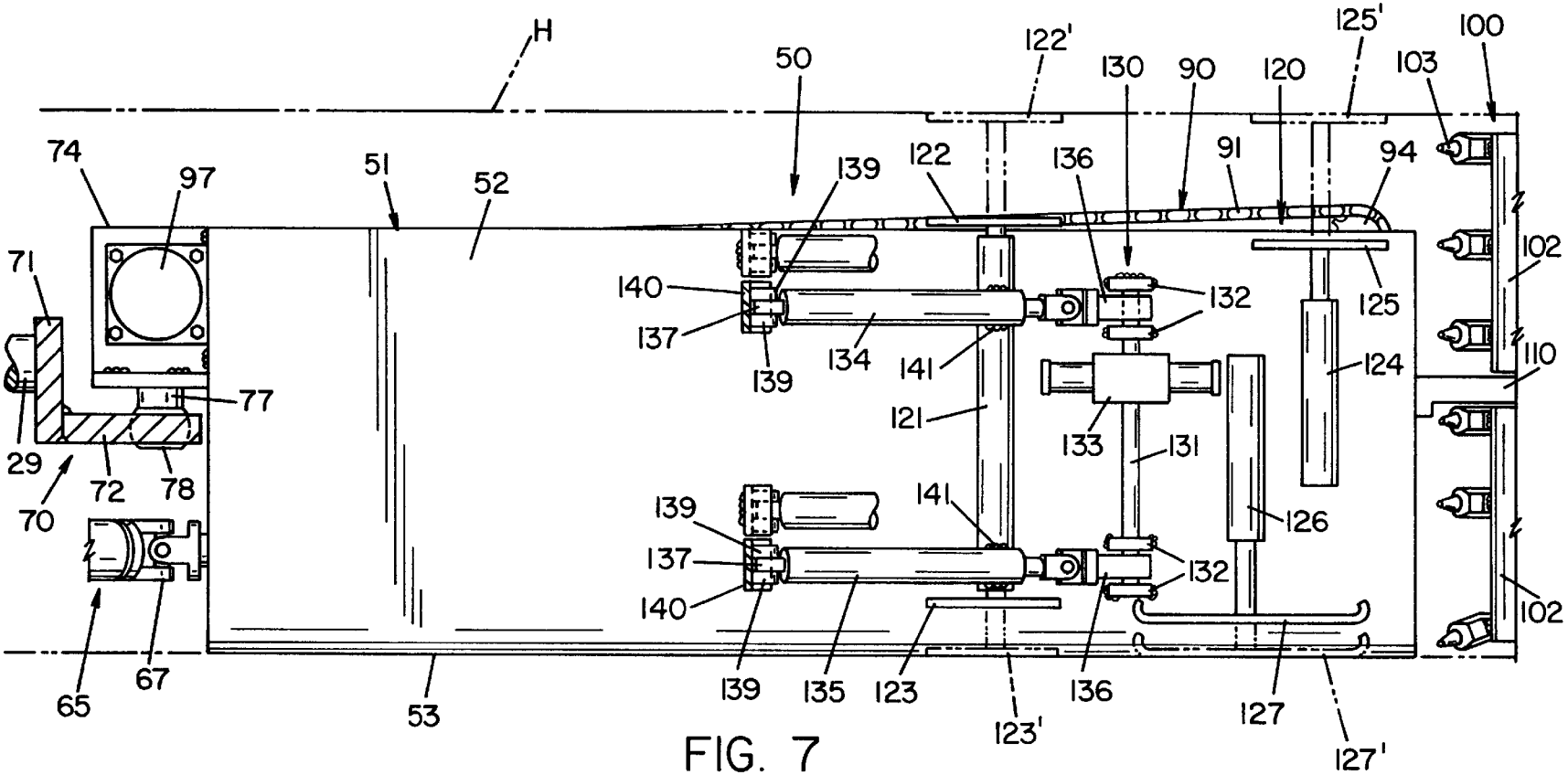
FIG. 7 is a vertical elevational view of the mining apparatus of FIG. 1 taken substantially along the line 7—7 of FIG. 1 and showing details of the wing spread control mechanism.

Referring now to FIGS. 4 and 7, each of the wing assemblies 50 and 50' have a wing clamping assembly, generally indicated by the numeral 120. The left cutter wing assembly 50 has a wing clamping assembly 120, and the cutter wing assembly 50' has a wing clamping assembly 120', both of which are located on the interior or inboard side of cutter wing assemblies 50, 50' and, like the other components of the cutter wing assemblies 50, 50', are substantially identical except that each is the mirror image of the other and that certain elements are offset to obviate interference. The wing clamping assembly 120 is provided to retain cutter wing assembly 50 in a preselected position while cutter carniage assembly 80 is moving along rails 84, 85 to expand a cut hole H in a manner hereinafter detailed. The wing clamping assembly 120 consists of a rear clamping cylinder 121 that activates a rear upper clamp plate 122 and a rear lower clamp plate 123. It will thus be appreciated that actuation of rear clamping cylinder 121 moves rear upper clamp plate 122 into engagement with the top of a cut hole H and rear lower clamp plate 123 into the bottom of a cut hole H.

The wing clamping assembly 120 also includes a front upper clamping cylinder 124 that powers a front upper clamp plate 125 from the retracted, solid-line position to the engagement position 125' with the top of a cut hole H. A front lower clamping cylinder 126 carries a front lower clamp plate 127 from the retracted, solid-line position of FIG. 7 to the extended position 127' contacting the lower surface of the cut hole H. The front upper clamping cylinder 124 and the front lower clamping cylinder 126 are attached to the vertical member 52 of the L-shaped frame 51 of cutter wing assembly 50. The rear clamping cylinder 121 is mounted in a manner hereinafter described.

Figure 8A:
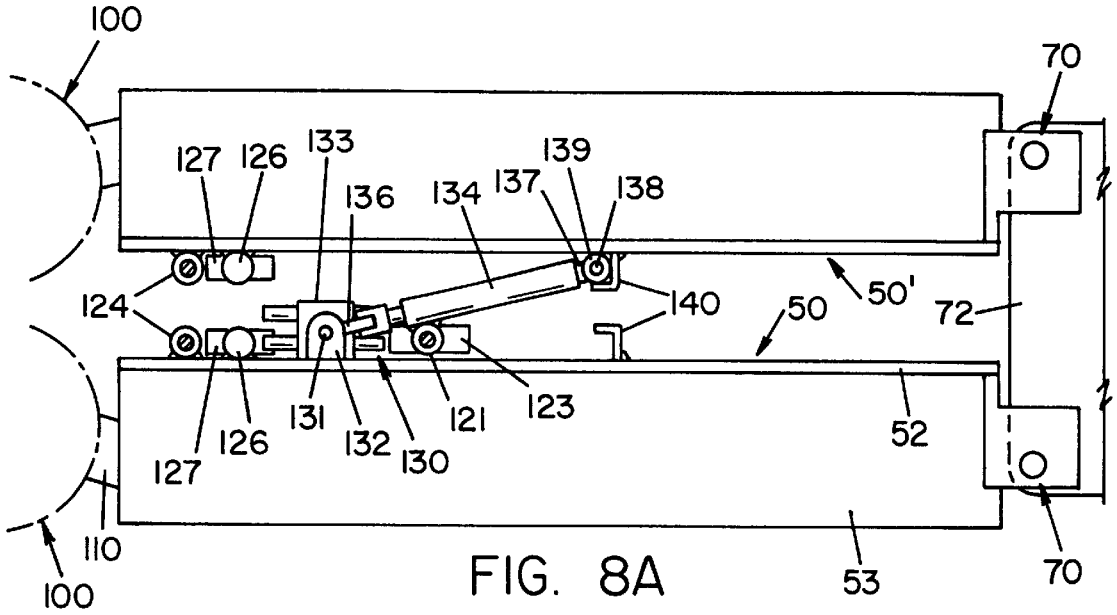
FIGS. 8A–8D schematically depict the sequence of operations of the wing-spread control mechanism in moving a wing from the closed to the open position.

Referring now particularly to FIGS. 4, 7, and 8A, the angular positioning of each of wing cutter assemblies 50 and 50' relative to mainframe assembly 21 is effected by a wing spreader assembly, generally indicated by the numeral 130, operating in conjunction with the wing clamping assembly 120. The wing spreader assembly 130 includes a rotating shaft 131 that moves in a plurality of spaced bearings 132 attached to vertical member 52 of L-shaped frame 51. As seen, the shaft 131 is substantially vertically mounted on the frame 51 and is selectively directionally rotated by a rotary actuator 133 shown mounted intermediate the length of the shaft 131. Operatively interrelated with the shaft 131 of wing spreader assembly 130 are an upper spreader cylinder 134 and a lower spreader cylinder 135 that, as seen in FIG. 7, are oriented substantially perpendicular to shaft 131 and substantially horizontal. The rod end of each of the spreader cylinders 134, 135 is attached by a clamping collet 136 to the shaft 131, such as to rotate with shaft 131, which is rotated by the rotary actuator 133. The blind ends of the cylinders 134, 135 have a projecting eye 137 that receives through shafts 138 which freely rotatably mounts rollers 139 to either side of the eye 137. The blind ends of cylinders 134, 135 are releasably retained in L-shaped brackets 140 that are mounted on the inner surface of vertical member 52 of L-shaped frame 51 of the cutter wing assembly 50' (see FIGS. 7 and 8A). Thus, the spreader cylinders 134, 135 are interconnected between the two cutter wing assemblies 50, 50' during a portion of their operational sequence, as hereinafter detailed. The upper spreader cylinder 134 and lower spreader cylinder 135 remain in a vertical plane during lateral horizontal motion because rear clamping cylinder 121 is affixed to both upper spreader cylinder 134 and lower spreader cylinder 135 as by welds 141. Synchronization of the cylinders 134, 135 assured by the parallelogram linkage created with the shaft 131 and rear clamping cylinder 121.

An exemplary operational capability of the manipulation of cutter wing assemblies 50, 50', with respect particularly to the cutter wing assembly 50, is depicted in the form of the sequential schematic top plan views of FIGS. 8A–8D. In FIG. 8A, the cutter wing assemblies 50 and 50' are shown in side-by-side, parallel alignment and in alignment with the mainframe assembly 21. Preparatory to an initial spreading of the cutter wing assembly 50, the front upper clamping cylinder 124 and the front lower clamping cylinder 126 of cutter wing assembly 50' are actuated to the clamping position. In the ensuing discussion regarding FIGS. 8A–8D, it will be assumed in all cases that the front lower clamping cylinder 126 is actuated to the clamping position or to the retracted position at any time the front upper clamping cylinder 124 is actuated to the clamping position or the retracted position with respect to both of the cutter wing assemblies and 50 and 50'. The front upper clamping cylinder 124 and the rear clamping cylinder 121 of cutter wing assembly 50 are activated to the rod retracted position.

Figure 8B:
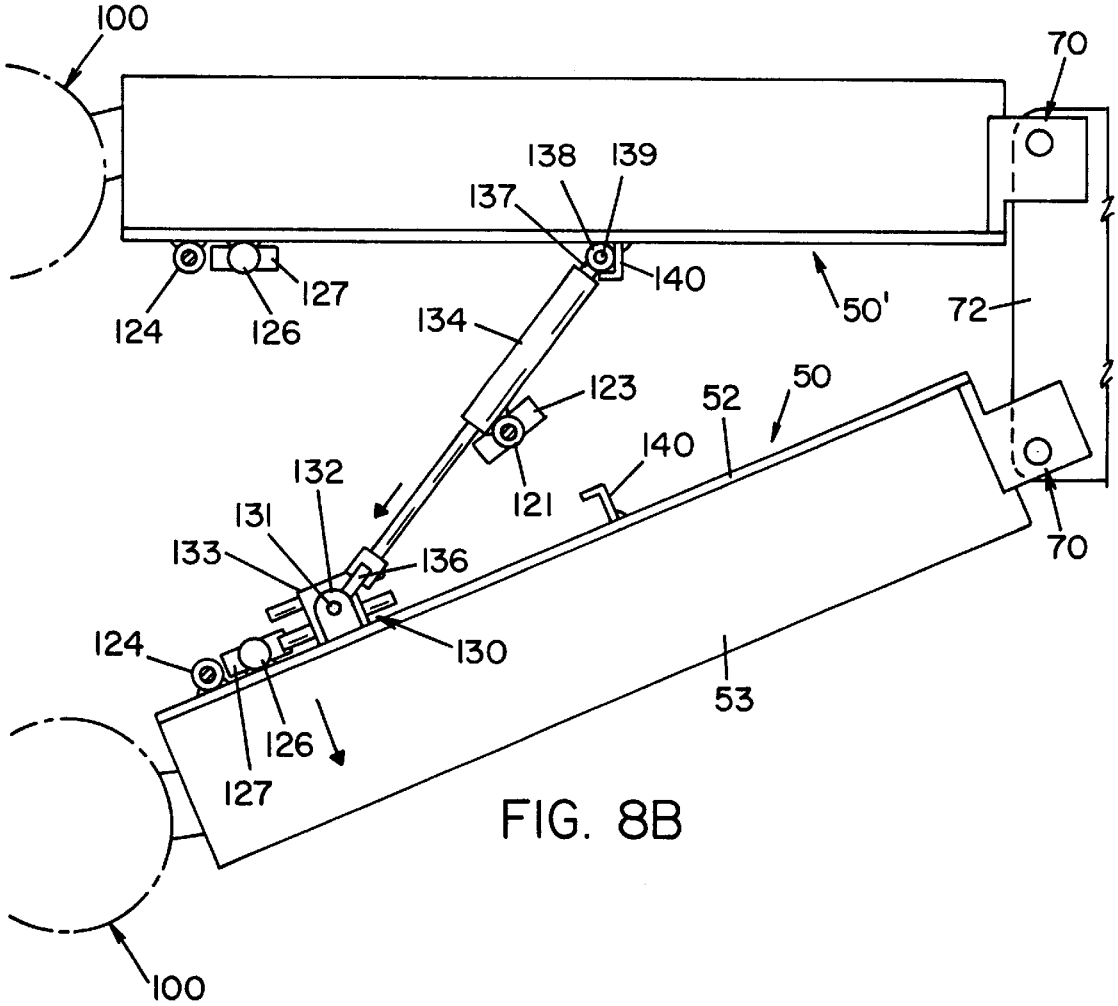
Figure 8C:
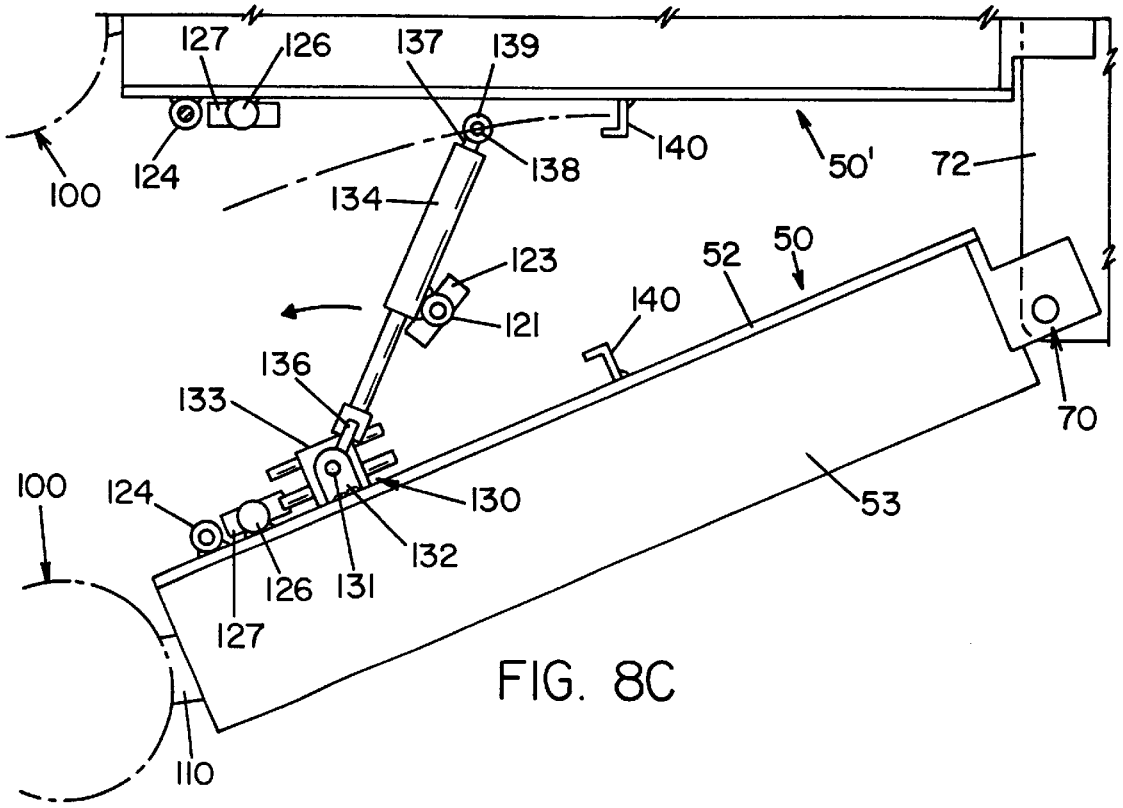

At that time, the spreader cylinders 134, 135 are actuated to rotate cutter wing assembly 50 about pivot assembly 70. As depicted in FIG. 8B, this actuation of the spreader cylinders 134, 135 produces an extent of clearance between cutter wing assemblies 50 and 50', such as to provide sufficient space for subsequent operating steps. Once the rods of spreader cylinders 134, 135 are fully extended, as essentially depicted in FIG. 8B with rollers 139 engaging L-shaped bracket 140 of cutter wing assembly 50', and the front cylinder 124 is clamped, the rotary actuator 133 is energized to effect counterclockwise rotation of spreader cylinders 134, 135 relative to shaft 131. This results in the rollers 139 at the blind end of spreader cylinders 134, 135 departing from their contacting relationship with the L-shaped bracket 140 and following an arcuate path, as depicted in FIG. 8C. The spreader cylinders 134, 135 are actuated to retract the rod contemporaneously with the activation of rotary actuator 133 in order to prevent interfering engagement of frame 51 of cutter wing assembly 50' with the rollers 139.

Figure 8D:
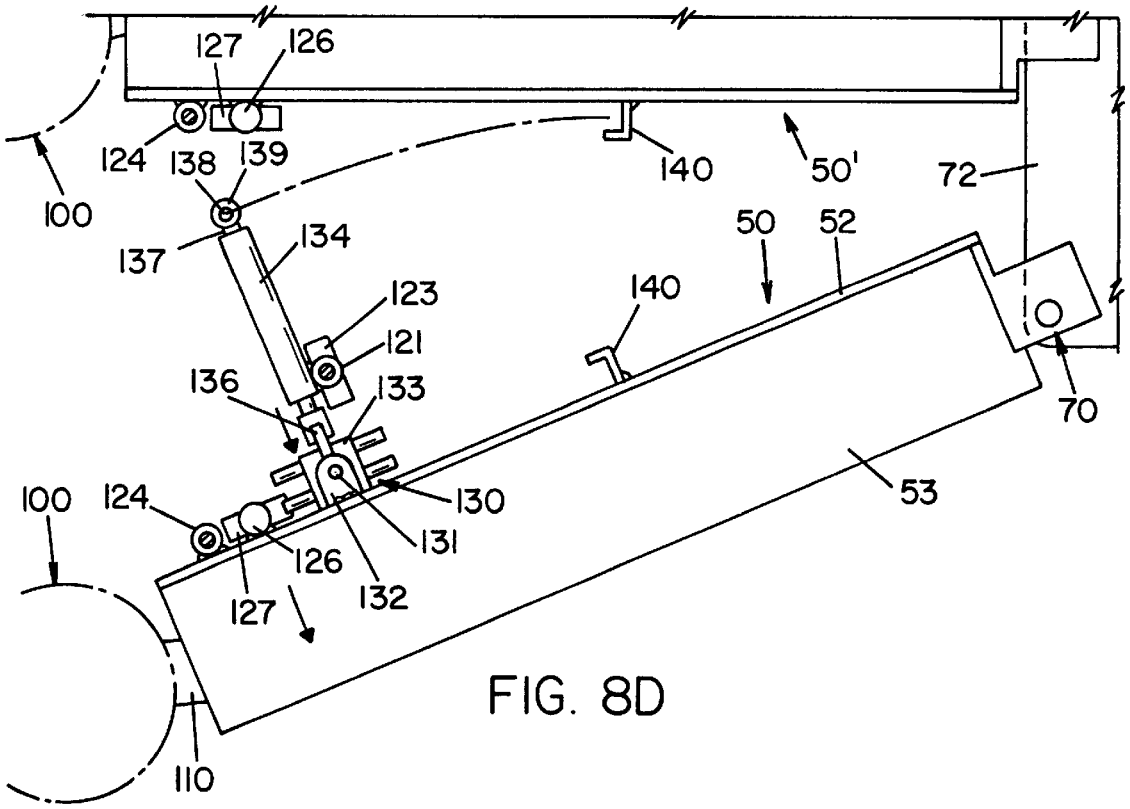

The operation of cutter cylinders 134 and 135 to retract the piston rods while the spreader cylinders 134, 135 are rotated about shaft 131 by actuation of rotary actuator 133 continues until a position of cutter wing assembly 50 components, as depicted in FIG. 8D, is achieved. At that point, the cylinder rod of spreader cylinders 134, 135 is substantially retracted, and the spreader cylinders 134, 135 are oriented substantially perpendicular to frame 51 of cutter wing assembly 50. While the orientation of FIG. 8D is desirable under certain circumstances, it may be appropriate to otherwise orient the spreader cylinders 134, 135 as by placing them more in parallel alignment with the mainframe assembly 21. Thereafter, the rear clamping cylinder 121 is actuated to the clamping position, with the front upper clamping cylinder 124 actuated to the clamping position to effect cutting operations by cutter assembly 100 along cutter wing assembly 50. After the conclusion of the cutting operation, the front upper clamping cylinder 124 is activated to the retracted position, such that the spreader cylinders 134, 135 may be actuated to extend the piston rods thereof to move the cutter wing assembly 50 into a further angularly-spread position from whence material can be cut by cutter assembly 100. Subsequent repetitions of the cutting and moving sequence from FIG. 8D permit any desired extent of angular pivoting of the cutter wing assembly 50 relative to mainframe assembly 21.

Figure 10:
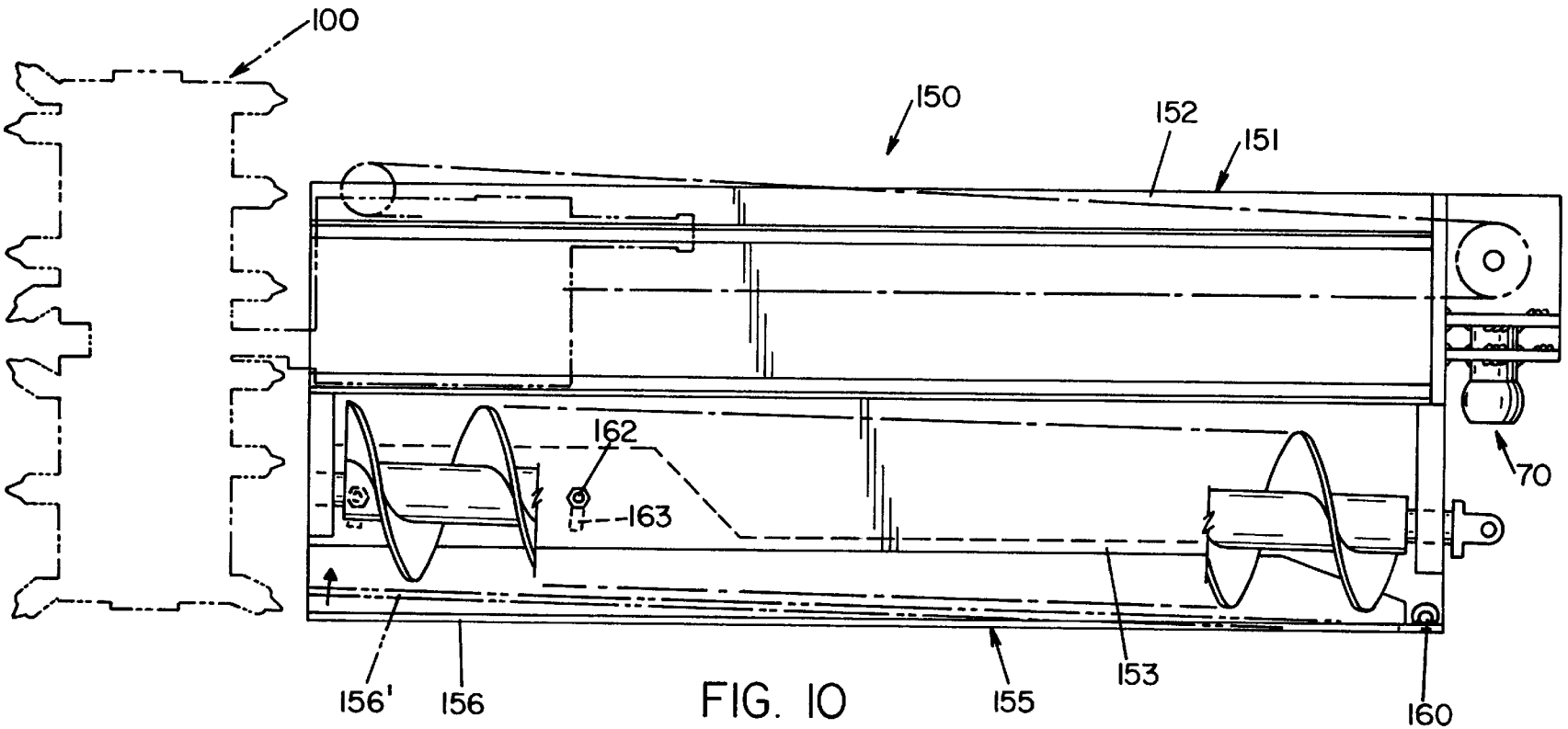
FIG. 10 is a side-elevational view of an alternate form of wing construction designed to steer the mining apparatus vertically to follow an undulating mineral seam.
Figure 11:
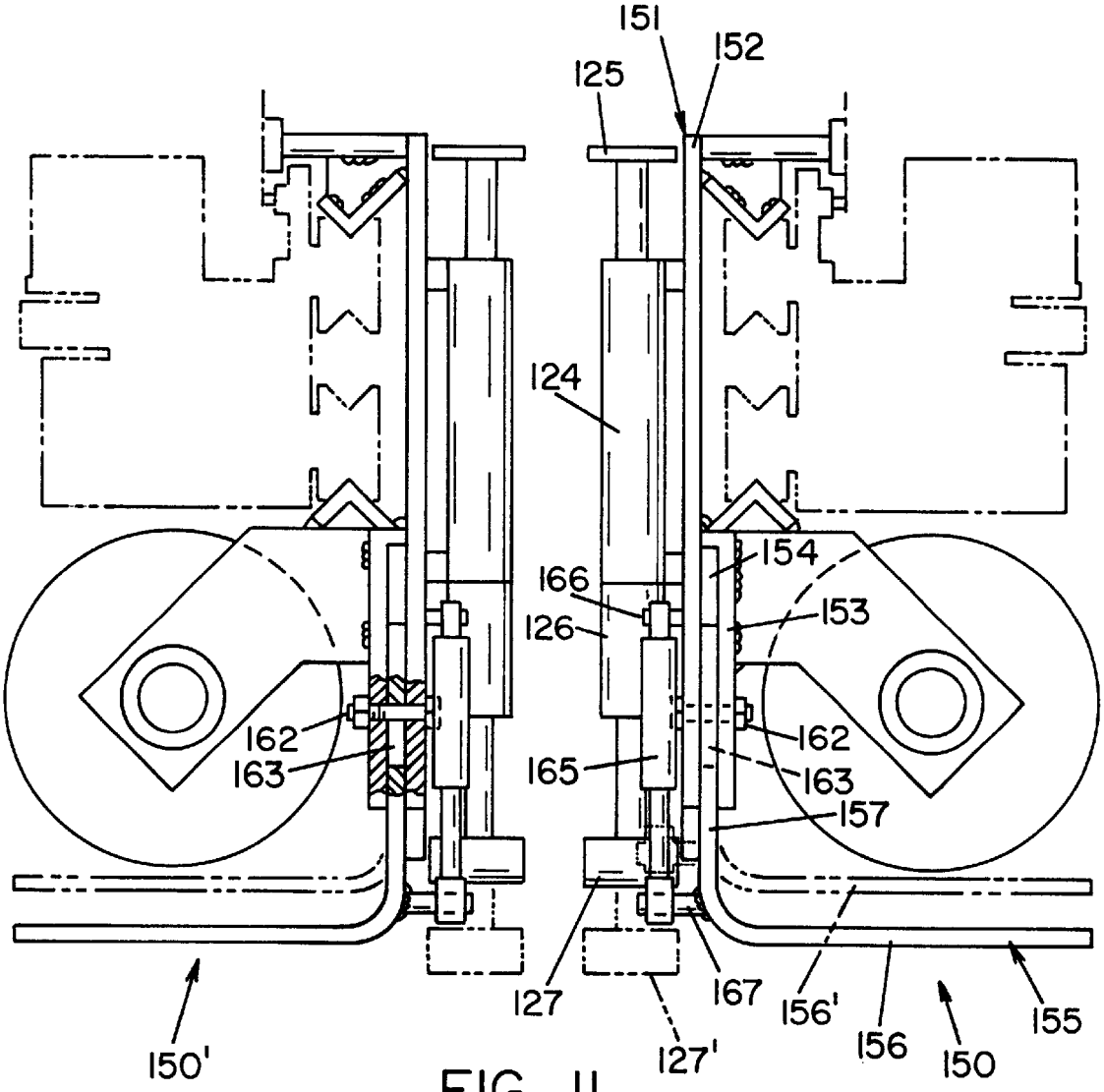
FIG. 11 is an elevational view similar to FIG. 4 showing the alternate form of wing construction of FIG. 10 and particularly the movable bottom plate for steering the mining apparatus.
Figure 12:
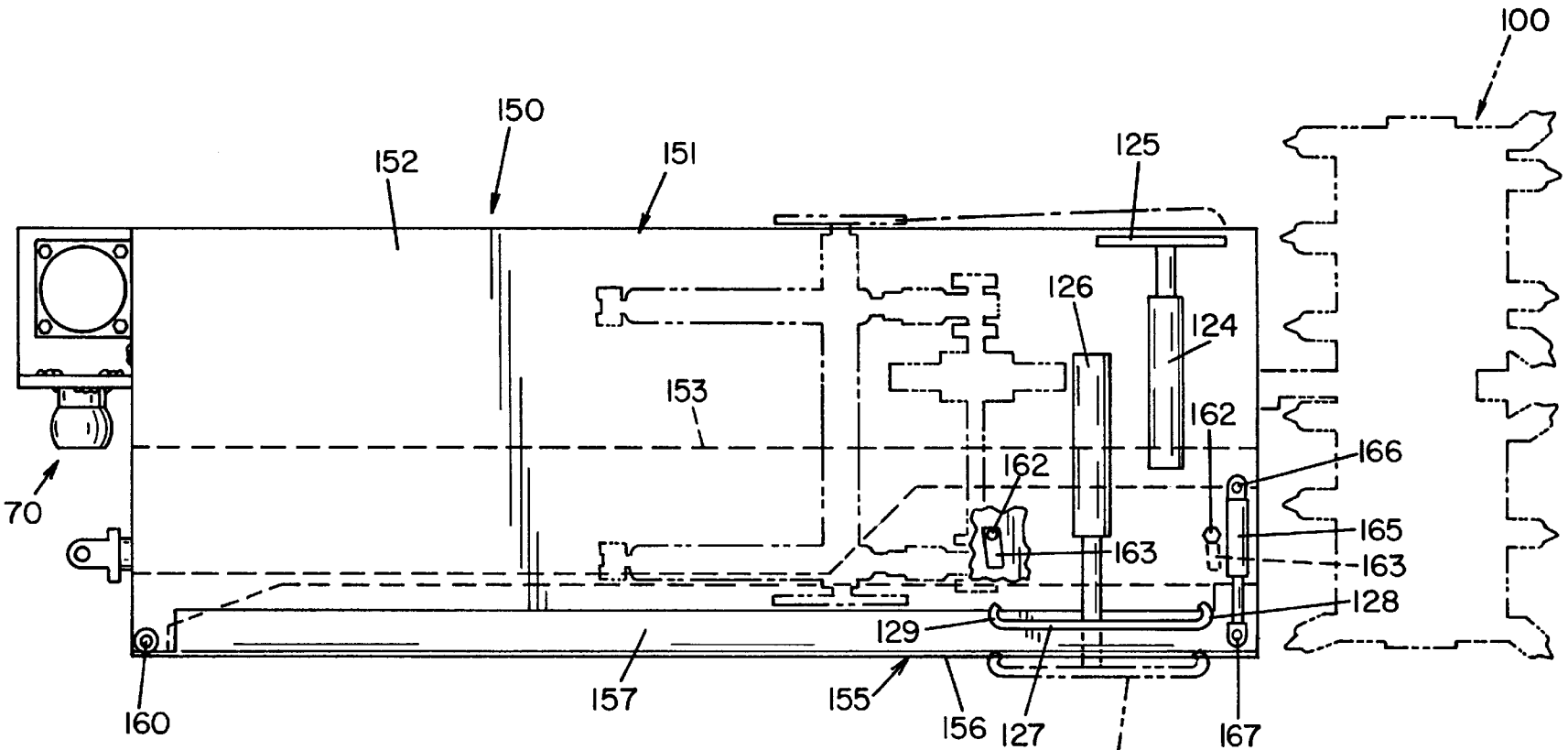
FIG. 12 is an elevational view similar to FIG. 7 showing the alternate form of wing construction of FIG. 10 and particularly the control elements for the movable bottom plate for steering the mining apparatus.

In order to effect vertical adjustments of the mining machine 20 during the entry phase to better follow a mineral seam and maintain the cut hole H centered therein, modified cutter wing assemblies 150 and 150', depicted in FIGS. 10–12 of the drawings, may advantageously be employed. Upward and downward steering of the cutter wing assemblies 150 and 150' is effected by a modified L-shaped frame 151. As in the instance of cutter wing assemblies 50 and 50', the structures are identical, except that each is the mirror image of the other, such that only the cutter wing assembly 150 is hereinafter described.

In essence, L-shaped frame 151 is a two-piece structure having a vertical member 152 with a downward extremity that is bifurcated by an attached retainer plate 153 to form a vertically-extending groove 154. The groove 154 receives an L-shaped bottom plate 155 having a horizontal leg 156 similar to horizontal member 53 of cutter wing assembly 50. A vertical leg 157 interfits within the groove 154 formed between vertical member 152 and retainer plate 153. The bottom plate 155 is fixed within groove 154 proximate the rear end of cutter wing assembly 150 by a pivot pin 160, such that bottom plate 155 is rotatable thereabout to raise and lower the front end of bottom plate 155. The extent of vertical movement of the front end of bottom plate 155 may be controlled by one or more throughbolts 162 that extend through vertical member 152 of L-shaped frame 151, through groove 154, and through retainer plate 153. The throughbolts 162 also extend through a vertical slot 163 in the vertical leg 157 of bottom plate 155, such that bottom plate 155 may move vertically the length of slots 163 about pivot pin 160. The vertical position of the front end of bottom plate 155 may be selectively controlled by a steer-down cylinder 165 having its blind end attached to a top pin 166, which is affixed to vertical member 152 of L-shaped frame 151 and its rod end attached to a bottom pin 167, which is affixed to vertical leg 157 of bottom plate 155.

The cutter wing assembly 150 is shown in solid lines in its normal operating position in FIGS. 10–12 of the drawings. As shown, the steer-down cylinder 165 has its rod extended with the bottom plate 155 extended downwardly, such that the throughbolts 162 engage the top of the slots 163. In this position, the horizontal leg 156 of bottom plate 155 is essentially perpendicular to the ends of the vertical member 152 of the frame 151. Actuation of the steer-down cylinder 165 to retract its rod raises bottom plate 155 at the front end thereof to raise the horizontal leg 156 to the chain-line position 156', as best seen in FIG. 11. This causes cutter wing assembly 150' to steer downwardly to maintain cutter assembly 100 selectively positioned within a mineral seam that is downwardly inclined.

In order to achieve upward steering of cutter wing assembly 150, the front lower clamping cylinder 126 may be actuated to extend the front lower clamp plate 127 from the retracted, solid-line position of FIG. 12 to the extended position 127', which is below the horizontal leg 156 of bottom plate 155. In this instance, the front upper clamp plate 125 operated by front upper clamping cylinder 124 is not actuated to permit upward steering or deflection of cutter wing assembly 150 while front lower clamp plate 127 is in the extended position 127' (see FIG. 12). Since the front lower clamp plate 127 is maintained extended during upward steering of cutter wing assembly 150, clamp plate 127 may have an upturned leading edge 128 and an upturned trailing edge 129 to prevent front lower clamp plate 127 from digging into or catching on the lower surface of the cut hole H. Thus, the cutter wing assemblies 150, 150' may be steered downwardly or upwardly to optimize following a mineral seam based upon information developed from prior cut holes H, from the cut hole H being made at the time, or during retreat mining based upon information developed during the entry phase of the mining operation.

An exemplary operating sequence for a method of mining minerals employing a mining machine 20 is schematically depicted in FIGS. 13A–13L. The mining machine 20 is depicted creating the cut hole H in a high wall W defined by the surface of the earth.

Figure 13A:
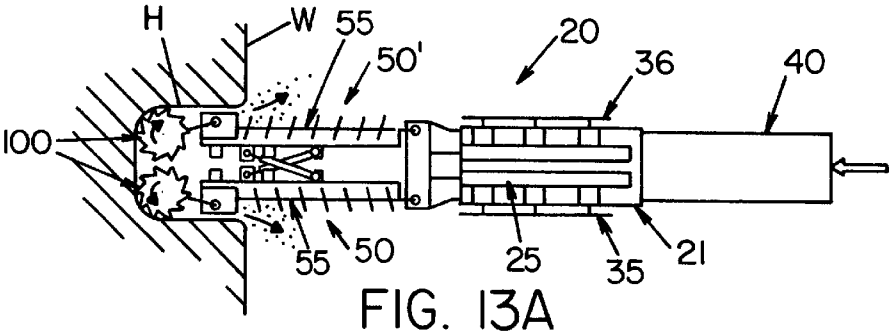
FIGS. 13A–13L schematically depict the sequence of operations of the mining apparatus of FIG. 1 during an operating cycle of entry and retreat in mining a seam of minerals.

As viewed throughout as a plan view, the mining machine 20 is depicted in FIG. 13A at initial entry into the high wall W. The cutter assemblies 100 on each cutter wing assembly 50, 50' are rotated counterclockwise and clockwise, respectively, as seen in a top plan presentation. The wing conveyor systems 55 of the cutter wing assemblies 50 and 50', being initially unconfined, deposit minerals outwardly of the high wall W, as seen in FIG. 13A.

Figure 13B:
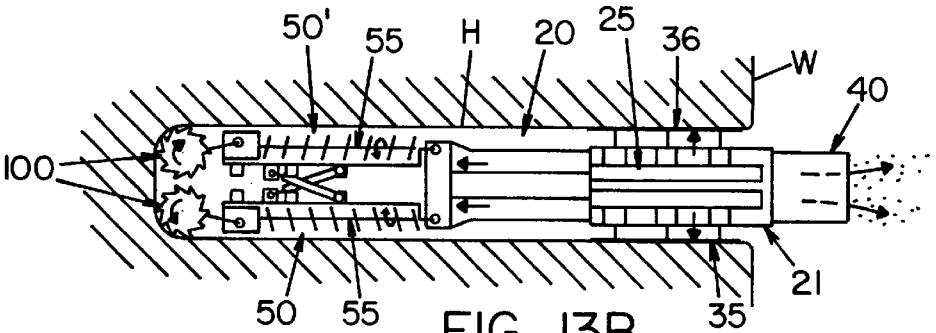
Figure 13C:
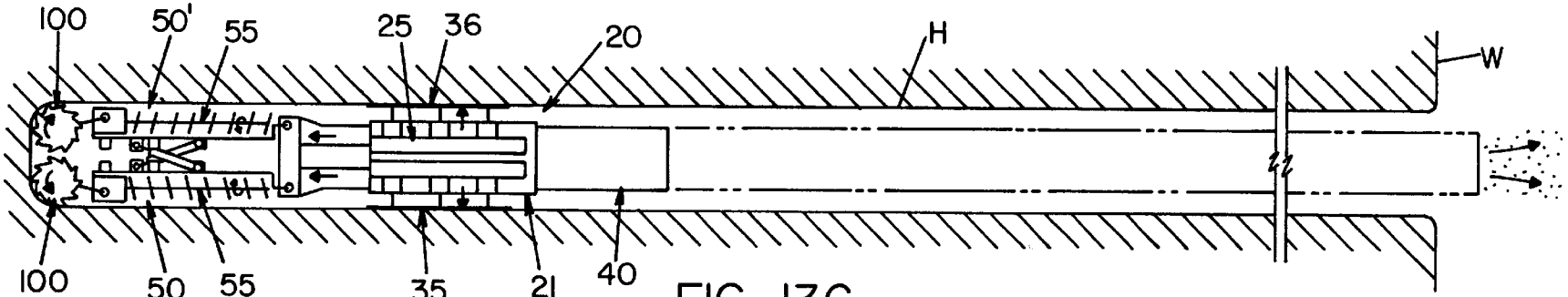

The mining machine 20 is advanced to produce a cut hole H following a mineral seam by advancing the cutter wing assemblies 50, 50' with the clamping mechanisms 35, 36 engaging the sides of the cut hole H, as depicted in FIG. 13B. When extension of the advance and retract cylinders 26, 27 of mainframe drive assembly 25 is completed, the clamping mechanisms 35, 36 are retracted out of engagement with the cut hole H, and the mainframe assembly 21 of mining machine 20 is advanced by retracting the advance and retract cylinders 26, 27 to pull the mainframe assembly 21 into close proximity to the cutter wing assemblies 50, 50', as seen in FIG. 13C. The clamping mechanisms 35, 36 are then expanded into engagement with the walls W of cut hole H preparatory to a further advance of cutter wing assemblies 50, 50', such that the cutter assemblies 100 effect further cutting advance into a mineral seam. As seen in FIG. 13B, with the mainframe assembly 21 within the cut hole H, cut minerals are discharged rearwardly of mining machine 20 by the wing conveyor system 55 and mainframe conveyor system 40 for discharge outside the high wall W. As the mining machine 20 proceeds further into a mineral seam from the high wall W, as seen in FIG. 13C, additional lengths of conveyor may be supplied in a manner well known in the art to continue the discharge of cut material outwardly of the high wall W.

Figure 13D:
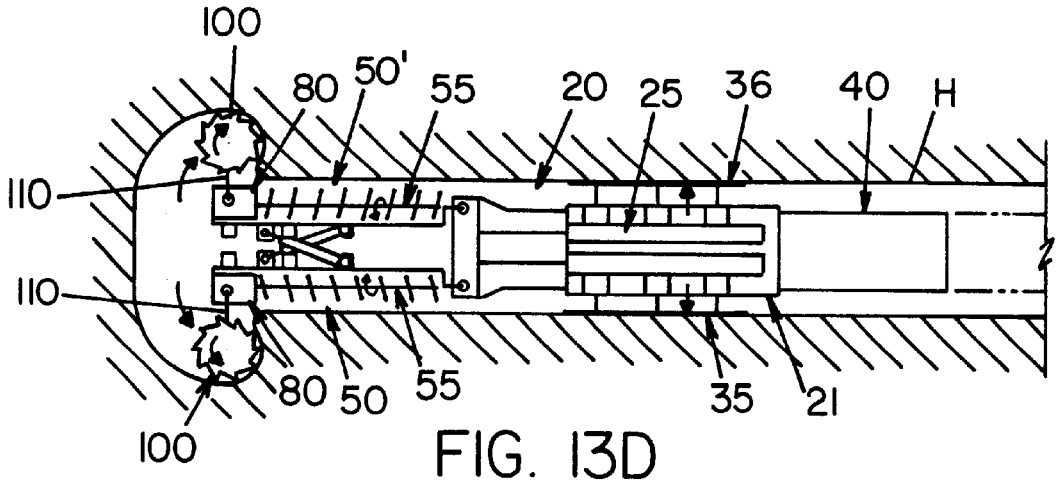

Once the cut hole H has reached a desired depth in a mineral seam, the clamping mechanisms 35, 36 are extended to engage the cut hole H to temporarily hold mining machine 20 in position, as depicted in FIG. 13D. At that time, with the cutter assemblies 100 continuing their cutting action, the rotary actuators 118 of cutting arms 110 are actuated to pivot the cutter assemblies 100 from a position in alignment with cutter wing assemblies 50, 50', as seen in FIG. 13C, to a position perpendicular to the cutter wing assemblies 50, 50', as seen in FIG. 13D.

Figure 13E:
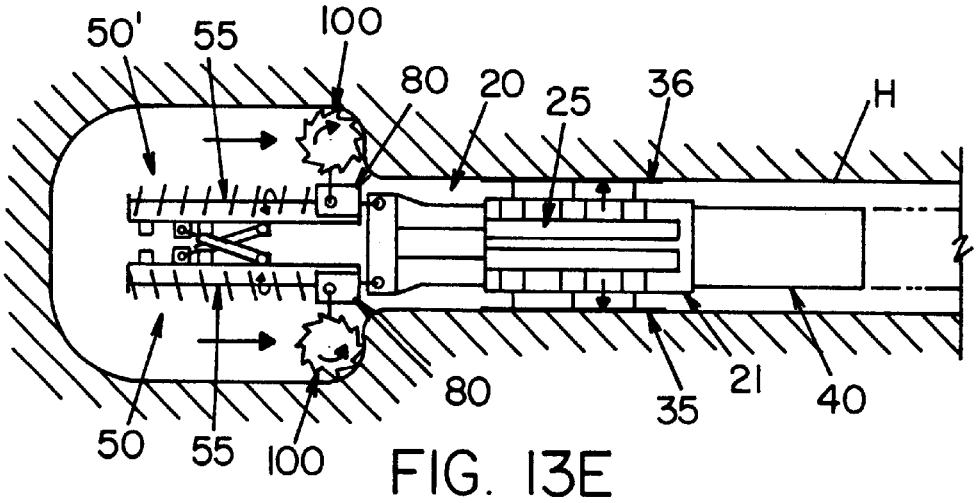

Thereafter, the carriage drive assemblies 90 of cutter carriage assemblies 80 are activated to move the cutter assemblies 100 lengthwise of, or from the front to the rear of, the cutter wing assemblies 50 and 50' to reach the position depicted in FIG. 13E of the drawings. During this widening cut of the original entry cut hole H, the cutter assemblies 100, 100 continue to deposit cut minerals for transport via the wing conveyor systems 55 and mainframe conveyor system 40 for deposit outwardly of the high wall W, as previously described.

Figure 13F:
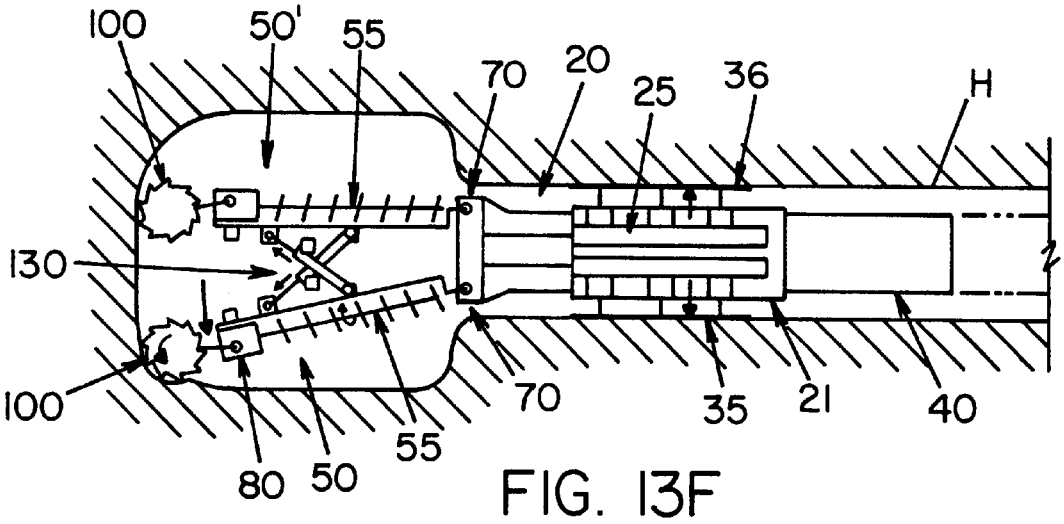

Once this widening cut is effected, the cutter assemblies 100 are returned to their position in alignment with cutter wing assemblies 50, 50' by actuation of cutter carriage assembly 80 and the pivoting of cutting arms 110, 110. At this time, the spreading of cutter wing assemblies 50 and 50' is commenced to effect angular displacement of the cutter wing assemblies 50 and 50' relative to mainframe assembly 21 by virtue of the pivot assemblies 70. The initial angular separation between cutter wing assembly 50 and cutter wing assembly 50' is effected by actuation of spreader cylinders 134, 135 of wing spreader assembly 130 associated with each of the cutter wing assemblies 50, 50', with the components of wing clamping assembly 120 being positioned as discussed hereinabove in conjunction with the description of FIGS. 8A–8D. With cutter assembly 100 continuing to cut as depicted in FIG. 13F, cutter wing assembly 50 is displaced angularly with respect to cutter wing assembly 50'.

Figure 13G:
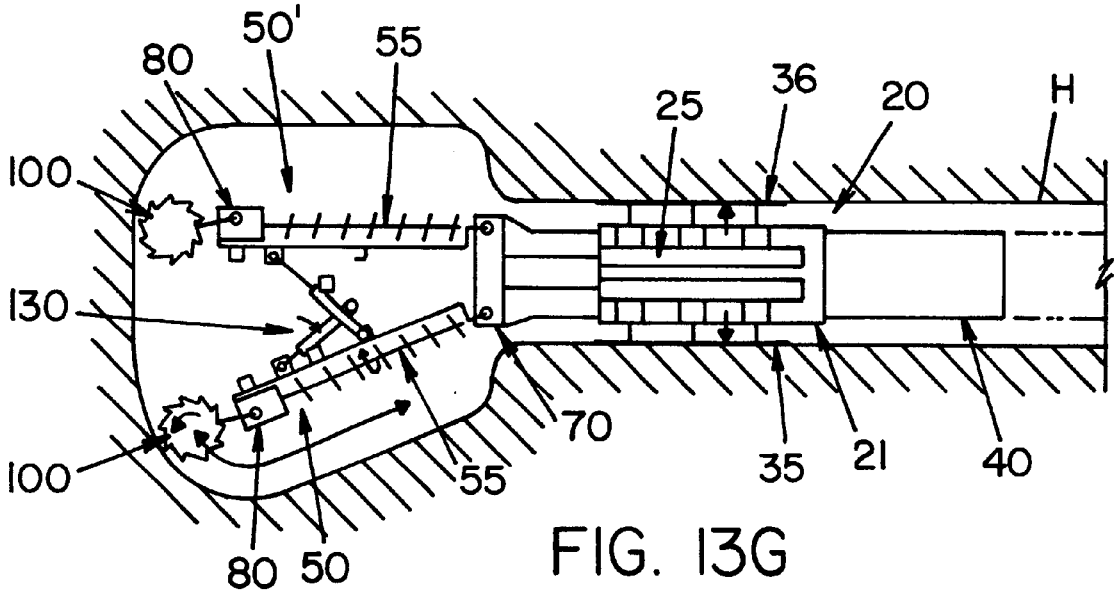
Figure 13H:
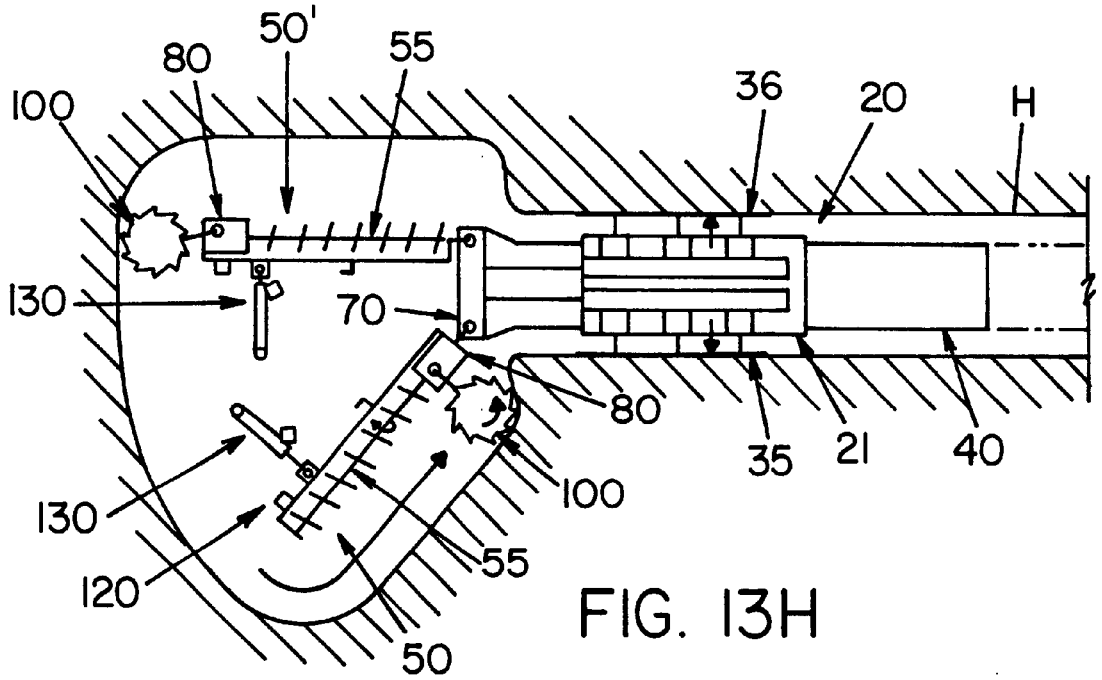

As seen in FIG. 13G, the wing spreader assembly 130 of cutter wing assembly 50 is disengaged from the cutter wing assembly 50', while the cutter assembly 100 is moved from alignment with cutter wing assembly 50 to a position perpendicular thereto and then along the length of cutter wing assembly 50, as depicted in FIG. 13G, to effect a further widening cut to the entry cut hole H. Suitable repetitions of this motion may be effected until the wing spreader assembly 130 associated with cutter wing assembly 50 can be repositioned perpendicular thereto by actuation of rotary actuator 133 to achieve the positioning depicted in FIG. 13H. Details of the positioning steps and actuation of wing clamping assembly 120 are discussed hereinabove in conjunction with the description of FIGS. 8C and 8D. Repeat sequencing of the wing clamping assembly 120 and wing spreader assembly 130, with intermittent movement of cutter assembly 100 along cutter wing assembly 50, may be employed to achieve any desired degree of angular positioning of cutter wing assembly 50 relative to cutter wing assembly 50'.

Figure 13I:
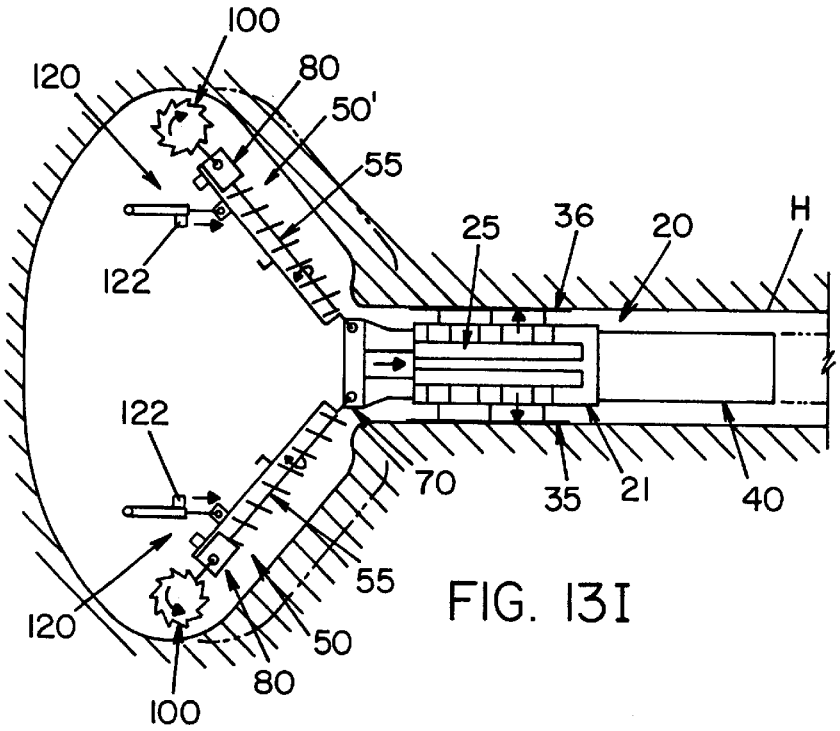

Thereafter, stepped angular movement of cutter wing assembly 50' may be effected in the manner just described for cutter wing assembly 50, with sequential cutting steps by cutter assembly 100 preceding each angular actuation of cutter wing assembly 50' until such time as cutter wing assemblies 50 and 50' are equiangularly disposed relative to the longitudinal axis of the mainframe assembly 21 of mining machine 20. Once the position depicted in FIG. 13I is achieved, the retreat mining operation commences in its most productive form, wherein the full widened area bounded by cutter wing assemblies 50, 50' is mined as the mining machine 20 retreats in step fashion from the entry cut hole H. In the retreat mining operation, the clamping mechanisms 35, 36 of mainframe assembly 21 are engaged, as are the rear upper clamp plates 122 of wing clamping assembly 120. At such time, the cutter wing assemblies 50 and 50' are moved toward the high wall W by actuation of the advance and retreat cylinders 26, 27 of mainframe drive assembly 25 to retract the piston rods and by synchronized extension of the piston rods of upper and lower spreader cylinders 134, 135 of the cutter wing assemblies 50, 50' into an area previously cleared by cutter assemblies 100 of the cutter wing assemblies 50, 50'. Release and movement of the clamping mechanisms 35, 36 of mainframe assembly 21 and wing clamping assemblies 120 to the retract piston rods of rear clamping cylinders 121 and extend the piston rods of advance and retract cylinders 26, 27 of mainframe drive assembly 25 is effected. Thereafter, wing clamping assemblies 120 and clamping mechanisms 35, 36 are actuated to the clamping position preparatory to a repetition of the motion of cutter assemblies 100 along the length of cutter wing assemblies 50 and 50' and are returned to the position depicted in FIG. 13I. This cut and advance sequence with cutter wing assemblies 50, 50' angularly displaced, as depicted in FIG. 13I is repeated through the entire retreat cutting operation or for a substantial portion of the retreat of mining machine 20 to the high wall W.

Figure 13J:
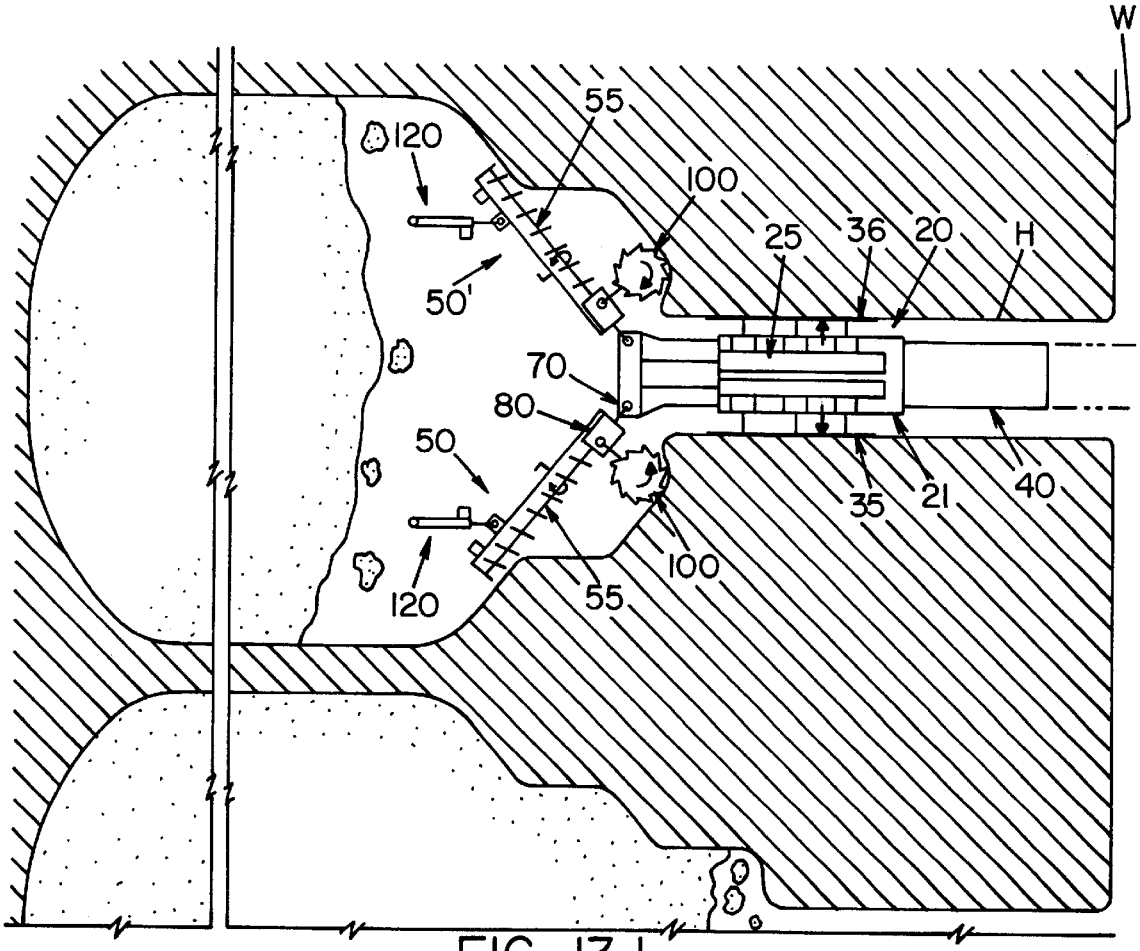
Figure 13K:
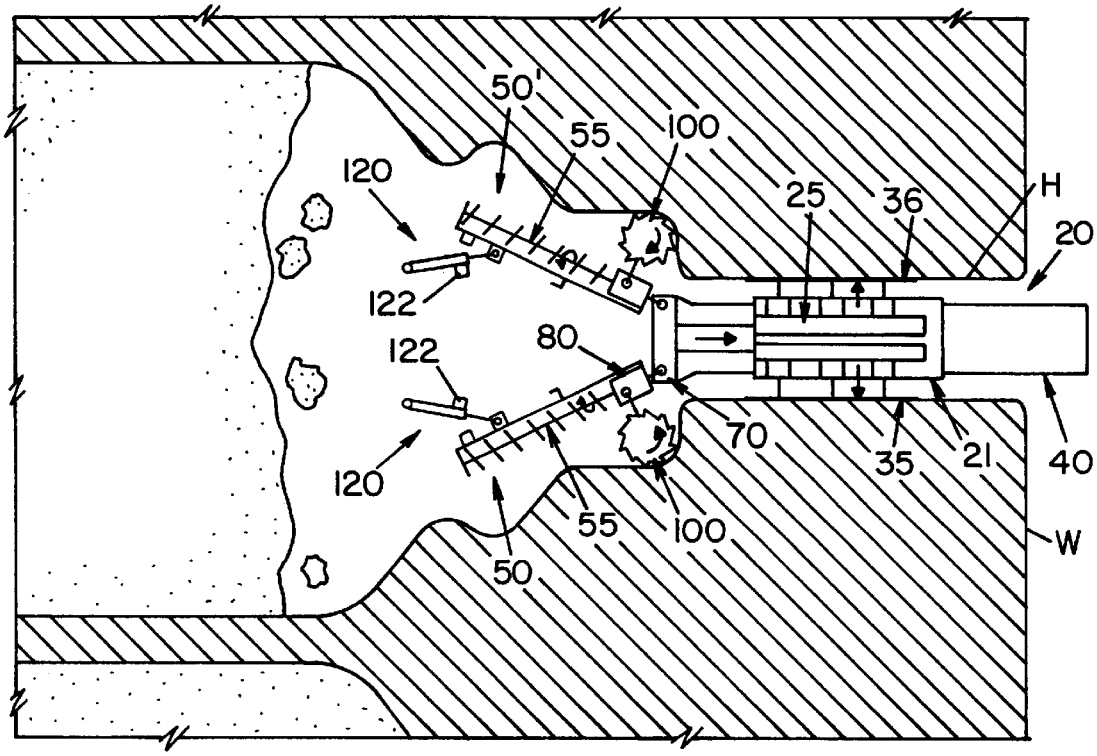
Figure 13L:
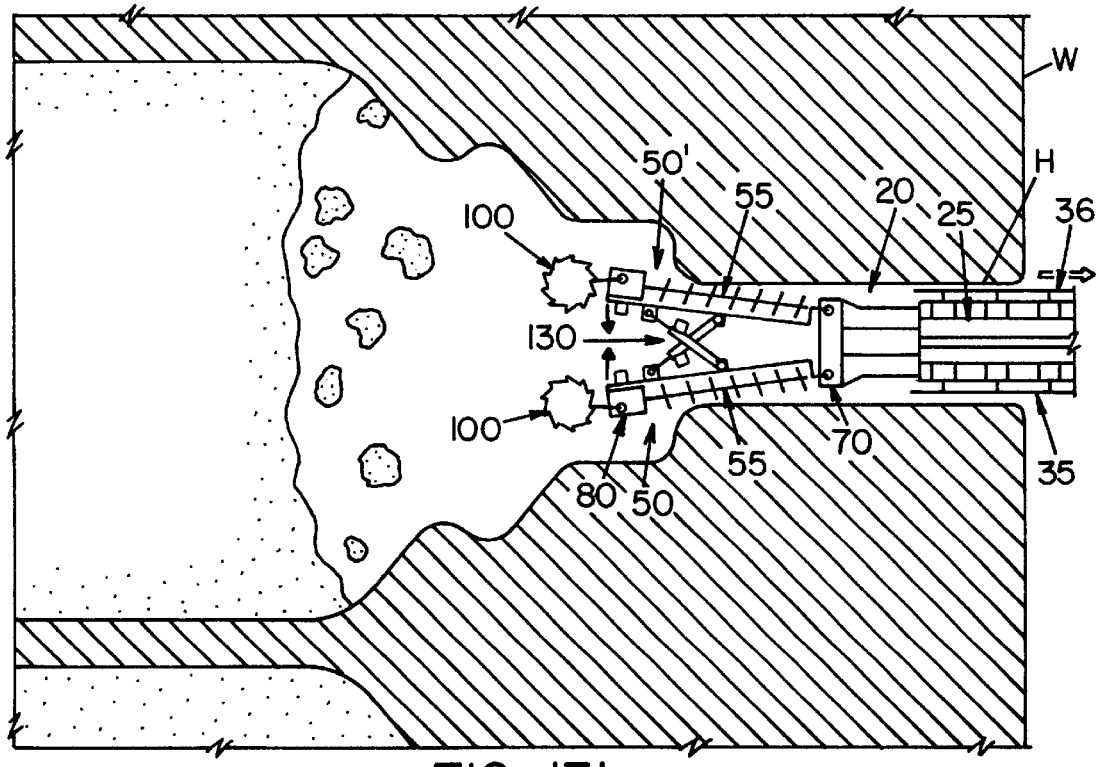

In instances where it is desirable to retain a high wall W substantially intact, an incremental closing or reduction in angularity of the cutter wing assemblies 50, 50' relative to the mainframe assembly 21 may be effected. In such instance, the procedure depicted in FIGS. 13J–13L may be employed. The cutter assemblies 100 are returned only a portion of the length of the cutter wing assemblies 50, 50' and subsequently effect a cut of only a portion of the length of the cutter wing assemblies 50, 50', as seen in FIG. 13J of the drawings.

Thereafter, the mainframe assembly 21 may be step-wise further withdrawn from the cut hole H, such that an even narrower cut is effected. In this respect, it will be appreciated that retaining the rear clamp plates 122, 123 in engagement with the top and bottom of the cut hole H while the mainframe drive assembly 25 retracts the pistons of advance and retract cylinders 26, 27 to thereby retract cutter wing assemblies 50 and 50' tends to angularly inwardly displace the cutter wing assemblies 50, 50', as can be seen in comparing FIGS. 13J and 13K of the drawings. Subsequent to achieving the position of FIG. 13K, rotation of the cutter assemblies 100 may be discontinued, and carriage drive assembly 90 may be disconnected, such that cutter assemblies 100 may be displaced along cutter wing assemblies 50 and 50'. The rear upper clamp plates 122 are retracted out of contact with cut hole H, and the engagement of cutter assemblies 100 with the coal causes further angular closing of the cutter wing assemblies 50, 50'. The rotary actuators 133 of wing spreader assemblies 130 are actuated to return the wing spreader assemblies 130 to their original position as collapse of the cutter wing assemblies 50, 50' to their original parallel position is effected, as depicted in process in FIG. 13L.

While an exemplary operating sequence for entry and retreat mining has been described hereinabove, it will be appreciated by persons skilled in the art that a great number of variations or alterations in the operating sequence may be employed with the flexibility of the mining machine 20 herein disclosed without departing from the scope of the present invention. For instance, the direction of rotation of the cutter assemblies 100 may be altered during some or all of the cutting operations from that depicted in FIGS. 12A–12L. Further, differing sequential operations of the various elements of the cutter wing assemblies 50 and 50' might be employed, depending upon the constitution of the mineral seam and the constitution of adjacent underground seams, and other operational factors. Also, the entry hole may be cut by a different machine, with the mining machine 20 providing the spreading and retreat cutting operations.

What is claimed is:

1. A mining machine for combined entry and retreat cutting of material located in underground seams comprising, a moveable mainframe, a wing extending ahead of said movable mainframe and having a first end and a second end, a cutter assembly positionable proximate said first end of said wing for entry cutting a hole in the material when said wing is aligned with the direction of movement of said mainframe, a pivotal connection between said mainframe and said second end of said wing for orienting said wing at an angle to the direction of movement of said mainframe, and a carriage mechanism for moving said cutter assembly along said wing for cutting of the material in proximity to said wing during retreat cutting of the material.

2. A mining machine according to claim 1, wherein said cutter assembly includes a drum cutter.

3. A mining machine according to claim 2, wherein said drum cutter has a vertical axis of rotation.

4. A mining machine according to claim 2, wherein said drum cutter produces a square entry hole.

5. A mining machine according to claim 1, wherein said cutter assembly is mounted on said carriage mechanism for moving said cutter assembly along said wing.

6. A mining machine according to claim 5, including a cutting arm carrying said cutter assembly and mounted for travel on rails affixed to and extending longitudinally on said wing.

7. A mining machine according to claim 6, wherein said carriage mechanism is selectively driven by a drive motor mounted on said wing.

8. A mining machine according to claim 1, wherein said wing has a wing conveyor for transfer of the material cut by said cutter assembly to said mainframe.

9. A mining machine according to claim 8, wherein said mainframe has a mainframe conveyor for receiving and transferring the material received from said wing conveyor.

10. A mining machine according to claim 9, including a conveyor interconnect mechanism joined to said wing conveyor and said mainframe conveyor by universal joints, thereby permitting angular spreading of said wing relative to said mainframe.

11. A mining machine according to claim 1, wherein said wing has a wing clamping assembly for selectively anchoring and releasing said wing relative to the material.

12. A mining machine according to claim 11, wherein said wing clamping assembly includes front and rear clamping cylinders each moving upper and lower clamping plates.

13. A mining machine according to claim 1, wherein said wing has a wing spreader assembly for orienting said wing at selected angles with respect to said mainframe.

14. A mining machine according to claim 13, wherein said wing spreader assembly includes at least one spreader cylinder pivotable about said wing to selected positions to angularly move said wing.

15. A mining machine according to claim 14, wherein one end of said at least one spreader cylinder is affixed to a pivot shaft mounted on said wing and a clamping cylinder selectively anchors said at least one spreader cylinder.

16. A mining machine according to claim 1, further comprising an additional wing paralleling said wing when both are aligned with said mainframe.

17. A mining machine according to claim 16, wherein said additional wing is pivotally connected to said mainframe for orienting said additional wing at an angle to the direction of movement of said mainframe in a direction opposite the orienting of said wing.

18. A mining machine according to claim 16, including means for maintaining said wing and said additional wing equiangularly displaced during retreat cutting.

19. A mining machine according to claim 16, wherein said wing and said additional wing are separately individually positioned and controlled.

20. A mining machine according to claim 1, wherein said cutter assembly includes a drum cutter having a motor mounted therein for rotating said drum cutter.

21. A method of mining minerals located in underground seams comprising the steps of:

cutting an entry hole with a cutter assembly mounted on a wing preceding a mainframe assembly, moving said cutter assembly lengthwise of said wing to effect a widening cut of the entry hole in the area adjacent to said wing, spreading said wing angularly into the widening cut effected by said cutter assembly, sequentially repeating the moving of said cutter assembly lengthwise of said wing to effect a further widening cut to the, entry hole and the spreading of said wing angularly into widening cuts until said wing is displaced through a desired angle, instituting retreat motion increments of said mainframe assembly and said wing subsequent to advance cuts by said cutter assembly lengthwise of said wings, whereby a retreat cut of a width exceeding the width of the entry hole is accomplished.

22. A method according to claim 21 further comprising the step of, orienting said cutter assembly in longitudinal alignment with said wing during the effecting of the entry cut hole.

23. A method according to claim 21 further comprising the step of, forming a rectangular entry cut hole by employing a cylindrical cutter rotating on a vertical axis.

24. A method according to claim 21 further comprising the step of, retracting said wing angularly toward alignment with said mainframe assembly prior to completing a retreat cut, whereby the entry area is maintained substantially intact.

25. A method according to claim 21 further comprising the step of, pivoting said cutter assembly out of alignment with said wing preparatory to moving of said cutter assembly lengthwise of said wing.

26. A method according to claim 21, further comprising the step of, employing a pair of wings, each mounting a cutter assembly.

27. A method according to claim 26 further comprising the step of, orienting each of said cutter assemblies in longitudinal alignment with its respective wing during the cutting of the entry hole.

28. A method according to claim 26 further comprising the step of, spreading said wings in opposite angular directions prior to instituting said retreat motion increments.

29. A method according to claim 28 further comprising the step of, leveraging a spreading mechanism of one of said wings against the other of said wings to initiate angular separation between said wings.

30. A method according to claim 26 further comprising the step of, fully spreading said pair of wings prior to instituting said retreat motion increments.

31. A method of mining minerals located in an underground seam comprising the steps of:

cutting an entry hole in the underground seam, locating a mining machine having a wing-mounted cutter assembly in the entry hole, moving said cutter assembly lengthwise of said wing to effect a widening cut of the entry hole in the area adjacent to said wing, spreading said wing angularly into the widening cut effected by said cutter assembly, sequentially repeating the moving of said cutter assembly lengthwise of said wing to effect a further widening cut to the entry hole and the spreading of said wing angularly into widening cuts until said wing is displaced through a desired angle, instituting retreat motion increments of said mining machine and said wing subsequent to advance cuts by said cutter assembly lengthwise of said wings, whereby a retreat cut of a width exceeding the width of the entry hole is accomplished.

32. A method of mining minerals from a seam comprising the steps of:

advance cutting an entry hole in the seam, positioning a mining machine having a wing mounting a cutter assembly in the entry hole, effecting a widening cut of the entry hole in the area adjacent to the wing by moving the cutter assembly along the wing, angularly displacing the wing into the widening cut of the entry hole, sequentially repeating the effecting of a widening cut and the angularly displacing of the wing into the widening cut until the wing is displaced through a desired angle, incrementally withdrawing the wing into retreat cuts by the cutter assembly along the wing while maintaining the wing at the desired angle, whereby a retreat cut of a width exceeding the width of the entry hole is accomplished.

33. A mining machine for retreat cutting of material located in seams comprising, a movable mainframe, first and second wings carried by said mainframe, cutter assemblies mounted on each of said first and second wings, carriages on each of said first and second wings for selectively moving said cutter assemblies along said first and second wings for cutting of the material in proximity to said first and second wings, and pivotal connectors between said mainframe and said first and second wings for orienting said first and second wings in opposite angular directions relative to the direction of movement of said mainframe.

34. A mining machine for retreat cutting of material located in seams comprising, a movable mainframe, a wing carried by said mainframe, a cutter assembly mounted on said wing for selective movement along said wing for cutting of the material in proximity to the wing, a pivotal connector between said mainframe and said wing permitting the orienting of said wing at an angle to the direction of movement of said mainframe, and a spreader assembly to angularly move said wing relative to said mainframe.

35. A mining machine according to claim 34 further comprising, a clamping mechanism interconnected with said spreader assembly to selectively release and anchor said spreader assembly in the material to incrementally move said wing.

* * * * *